US007959246B2

(12) United States Patent
Hamasaki et al.

(10) Patent No.: US 7,959,246 B2
(45) Date of Patent: Jun. 14, 2011

(54) APPARATUS AND METHOD FOR DRIVING FIRST AND SECOND NOZZLE ARRAYS

(75) Inventors: Yuji Hamasaki, Kawasaki (JP); Takuji Katsu, Kawasaki (JP); Osamu Iwasaki, Tokyo (JP); Norihiro Kawatoko, Yokohama (JP); Atsushi Sakamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 387 days.

(21) Appl. No.: 11/610,149

(22) Filed: Dec. 13, 2006

(65) Prior Publication Data

US 2007/0139510 A1 Jun. 21, 2007

(30) Foreign Application Priority Data

Dec. 14, 2005 (JP) ..... 2005-360835
Dec. 7, 2006 (JP) ..... 2006-331143

(51) Int. Cl.
*B41J 29/38* (2006.01)
*B41J 2/145* (2006.01)

(52) U.S. Cl. ..... 347/12; 347/5; 347/40

(58) Field of Classification Search ..... 347/9, 12
See application file for complete search history.

(56) References Cited

U.S. PATENT DOCUMENTS 4,313,124 A 1/1982 Hara
4,345,262 A 8/1982 Shirato et al.
4,463,359 A 7/1984 Ayata et al.
4,558,333 A * 12/1985 Sugitani et al. ..... 347/65
4,723,129 A 2/1988 Endo et al.
4,740,796 A 4/1988 Endo et al.
5,280,310 A * 1/1994 Otsuka et al. ..... 347/12
5,774,145 A 6/1998 Morita et al.
5,805,182 A 9/1998 Lee
6,257,690 B1 7/2001 Holstun
6,257,691 B1 7/2001 Iwasaki et al.
6,312,096 B1 11/2001 Koitabashi et al.
6,325,492 B1 12/2001 Koitabashi et al.
6,592,203 B1 7/2003 Bates et al.
6,637,865 B1 10/2003 Murakami et al.
6,705,694 B1 * 3/2004 Barbour et al. ..... 347/9
6,846,066 B2 1/2005 Teshikawara et al.
6,877,833 B2 4/2005 Teshigawara et al.
6,899,413 B2 5/2005 Otsuka et al.
6,984,009 B2 * 1/2006 Nakagawa et al. ..... 347/9
2002/0054179 A1 * 5/2002 Shibata et al. ..... 347/15

(Continued)

FOREIGN PATENT DOCUMENTS

JP 8-183179 7/1996

(Continued)

*Primary Examiner* — Shelby Fidler
(74) *Attorney, Agent, or Firm* — Fitzpatrick, Cella, Harper & Scinto

(57) ABSTRACT

A printing apparatus prints on a printing medium by using a printhead which has a first nozzle array including a plurality of nozzles from which a first nozzle amount of the ink is discharged and a second nozzle array including a plurality of nozzles from which a second nozzle amount of the ink is discharged. This printing apparatus time-divisionally drives a plurality of blocks obtained by dividing each of the first nozzle array and the second nozzle array. The printing apparatus selects, from the first nozzle array and the second nozzle array, a block to be driven by the driving unit within a predetermined period. This printing apparatus controls the selection unit to alternately select a block from the first nozzle array and the second nozzle array and sequentially select a block from each nozzle array in a predetermined order.

16 Claims, 25 Drawing Sheets

U.S. PATENT DOCUMENTS

| | | | | |
|---|---|---|---|---|
| 2002/0054182 | A1* | 5/2002 | Yazawa | 347/23 |
| 2002/0167560 | A1* | 11/2002 | Fujimori | 347/15 |
| 2002/0175961 | A1* | 11/2002 | Iwasaki et al. | 347/15 |
| 2003/0007024 | A1* | 1/2003 | Fujimori | 347/15 |
| 2003/0142153 | A1* | 7/2003 | Nakajima et al. | 347/9 |
| 2004/0021717 | A1* | 2/2004 | Nakajima et al. | 347/12 |
| 2005/0122373 | A1 | 6/2005 | Katsu et al. | |
| 2005/0275681 | A1 | 12/2005 | Nakagawa et al. | |
| 2006/0050107 | A1* | 3/2006 | Yamanaka et al. | 347/40 |
| 2006/0187247 | A1 | 8/2006 | Takahashi et al. | |
| 2008/0049055 | A1* | 2/2008 | Edamura et al. | 347/9 |

FOREIGN PATENT DOCUMENTS

| | | |
|---|---|---|
| JP | 8-295033 | 11/1996 |
| JP | 2000-071433 | 3/2000 |
| JP | 2001-129997 | 5/2001 |

* cited by examiner

FIG. 12

| BLK NUM | Nozzle No | | | | | | | | | | | |
|---|---|---|---|---|---|---|---|---|---|---|---|---|
| BE0 | 176 | 160 | 144 | 128 | 112 | 96 | 80 | 64 | 48 | 32 | 16 | 0 |
| BE1 | 177 | 161 | 145 | 129 | 113 | 97 | 81 | 65 | 49 | 33 | 17 | 1 |
| BE2 | 178 | 162 | 146 | 130 | 114 | 98 | 82 | 66 | 50 | 34 | 18 | 2 |
| BE3 | 179 | 163 | 147 | 131 | 115 | 99 | 83 | 67 | 51 | 35 | 19 | 3 |
| BE4 | 180 | 164 | 148 | 132 | 116 | 100 | 84 | 68 | 52 | 36 | 20 | 4 |
| BE5 | 181 | 165 | 149 | 133 | 117 | 101 | 85 | 69 | 53 | 37 | 21 | 5 |
| BE6 | 182 | 166 | 150 | 134 | 118 | 102 | 86 | 70 | 54 | 38 | 22 | 6 |
| BE7 | 183 | 167 | 151 | 135 | 119 | 103 | 87 | 71 | 55 | 39 | 23 | 7 |
| BE8 | 184 | 168 | 152 | 136 | 120 | 104 | 88 | 72 | 56 | 40 | 24 | 8 |
| BE9 | 185 | 169 | 153 | 137 | 121 | 105 | 89 | 73 | 57 | 41 | 25 | 9 |
| BE10 | 186 | 170 | 154 | 138 | 122 | 106 | 90 | 74 | 58 | 42 | 26 | 10 |
| BE11 | 187 | 171 | 155 | 139 | 123 | 107 | 91 | 75 | 59 | 43 | 27 | 11 |
| BE12 | 188 | 172 | 156 | 140 | 124 | 108 | 92 | 76 | 60 | 44 | 28 | 12 |
| BE13 | 189 | 173 | 157 | 141 | 125 | 109 | 93 | 77 | 61 | 45 | 29 | 13 |
| BE14 | 190 | 174 | 158 | 142 | 126 | 110 | 94 | 78 | 62 | 46 | 30 | 14 |
| BE15 | 191 | 175 | 159 | 143 | 127 | 111 | 95 | 79 | 63 | 47 | 31 | 15 |

FIG. 24A

| PRINTING MODE | TYPES | USAGE NOZZLE | | TOGGLE MODE | | THE NUMBER OS PASSES | SPEED |
|---|---|---|---|---|---|---|---|
| — | — | SMALL | LARGE | BLOCK | COLUMN | — | — |
| 1 | PLAIN SHEET | UNUSED | USED | — | — | 1 | 30 |
| 2 | PLAIN SHEET | USED | USED | ○ | — | 1 | 25 |
| 3 | PLAIN SHEET | USED | UNUSED | — | — | 1 | 12.5 |

FIG. 24B

| PRINTING MODE | TYPES | USAGE NOZZLE | | TOGGLE MODE | | THE NUMBER OS PASSES | SPEED |
|---|---|---|---|---|---|---|---|
| — | — | SMALL | LARGE | BLOCK | COLUMN | — | — |
| 1 | SPECYALY SHEET 1 | UNUSED | USED | — | — | 1 | 30 |
| 2 | SPECYALY SHEET 1 | USED | USED | ○ | — | 2 | 25 |
| 3 | SPECYALY SHEET 1 | USED | USED | — | ○ | 4 | 25 |

FIG. 24C

| PRINTING MODE | TYPES | USAGE NOZZLE | | TOGGLE MODE | | THE NUMBER OS PASSES | SPEED |
|---|---|---|---|---|---|---|---|
| — | — | SMALL | LARGE | BLOCK | COLUMN | — | — |
| 1 | PLAIN SHEET | UNUSED | USED | — | — | 1 | 30 |
| 2 | PLAIN SHEET | UNUSED | USED | — | — | 1 | 25 |
| 3 | SPECYALY SHEET 1 | USED | USED | ○ | — | 6 | 25 |
| 4 | SPECYALY SHEET 2 | USED | USED | — | ○ | 12 | 25 |
| 5 | SPECYALY SHEET 1 | USED | UNUSED | — | — | 16 | 25 |

APPARATUS AND METHOD FOR DRIVING FIRST AND SECOND NOZZLE ARRAYS

BACKGROUND OF THE INVENTION

1. Field of the Invention

The present invention relates to a printing apparatus, printing apparatus control method, printhead control circuit, and printhead driving method.

More specifically, a printhead comprises a common ink chamber to supply a liquid, a first nozzle array which is arranged in the longitudinal direction of the common ink chamber, and a second nozzle array which is arranged in parallel to the first nozzle array and has a nozzle diameter smaller than that of the first nozzle array. The printhead further comprises a plurality of liquid chambers having openings to first and second nozzles and communicating with the common liquid chamber. A printing apparatus with a printhead drives and controls the printhead that prints on a printing medium by discharging liquids from the first and second nozzles.

2. Description of the Related Art

Along with the recent developments in personal computers, printer technology is also progressing remarkably. A printing apparatus is configured to print an image on a printing paper sheet on the basis of image information.

A printing scheme of a printing apparatus that has recently received a great deal of attention is an inkjet printing scheme. An inkjet printing apparatus discharges ink from a printhead to a printing paper sheet. This scheme allows high-speed printing of high-resolution images and is superior to other printing schemes in various points including running cost and quietness.

The inkjet printing scheme is known to use an electrothermal transducer that generates thermal energy serving as ink droplet discharge energy. In this method, minute nozzles arranged on an inkjet printhead discharge minute ink droplets to print on a printing medium such as a paper sheet.

An inkjet printhead using electrothermal transducers includes a driving system to form ink droplets and a supply system to supply ink to the driving system. The electrothermal transducers are generally provided in a compression chamber. An electrical pulse serving as a print signal is applied to the electrothermal transducers to give thermal energy to the ink. An abrupt phase change of the ink, i.e., the pressure of bubbles generated upon vaporization, is used to discharge the ink.

An inkjet printhead (to be referred to as a printhead hereinafter) normally employs time-divisional drive to execute discharge from the nozzles. Time-divisional drive can improve the ink supply speed and stability and reduce power consumption during discharge. Generally, a plurality of nozzles arranged in a line are divided into several nozzle groups and driven at different timings in each nozzle group.

For example, Japanese Patent Laid-Open No. 2000-071433 proposes time-divisional drive (driving). Nozzles are driven by time-divisional drive at, e.g., a timing shown in FIG. 2. In this example, one nozzle array (one nozzle array will be referred to as one column hereinafter) is divided into groups of 16 adjacent nozzles. The 16 consecutive nozzles are driven at 16 different timings.

In other words, every 16 nozzles are driven at the same timing. Each group of these 16 nozzles is called a block. A method of sequentially driving a plurality of nozzles in each block is called time-divisional drive. Referring to FIG. 2, a indicates breaks in a nozzle array, and b indicates the discharge timings of 16 consecutive nozzles.

The ordinate represents the nozzle position in one column, and the abscissa represents the time. Nozzles 1 to 16 are driven in order. The printhead continuously moves during printing. As a result, dots printed by nozzles 1 to 16 are arranged spatially as indicated by b. Simultaneous with the driving of nozzle 1, every 16 nozzles, i.e., nozzles 17, 34, 49, . . . of the same block are also driven.

To aid in understanding time-divisional drive, nozzles 1 to 16 are sequentially driven in the above description. In actual time-divisional drive, nozzles are distributedly driven on the basis a predetermined driving sequence table. This suppresses the influence of adjacent nozzles in nozzles 1 to 16 when using time-divisional drive.

The mainstream aiming at reproducing a higher image quality is a printhead that has color (magenta, yellow, and magenta) heads each including a large nozzle array (hereinafter also referred to as L nozzle array in the Drawings) and a small nozzle array (hereinafter also referred to as S nozzle array in the Drawings), as shown in FIG. 3. This printhead can produce a high-quality image by combining large ink droplets discharged from the large nozzle arrays and small ink droplets discharged from the small nozzle arrays.

An inkjet printer disclosed in, e.g., Japanese Patent Laid-Open No. 08-183179 prints by using an inkjet printhead that has orifices capable of discharging ink droplets of a plurality of sizes while sequentially changing the ink droplet size during single scanning or in every scanning.

The inkjet printer of Japanese Patent Laid-Open No. 08-183179 proposes shifting the ink droplet discharge timing. Namely, this prior art proposes shifting large ink droplets discharged from large nozzles (hereinafter also referred to as L nozzle in the Drawings) and small ink droplets discharged from small nozzles (hereinafter also referred to as S nozzle in the Drawings) relative to a printing paper sheet so that the ink droplets of the plurality of sizes can compensate for each other.

As inkjet printers are recently becoming cheaper, the cost of printheads also must be reduced. A low-cost printer uses a printhead that uses common driving and heat pulse signals for the large and small nozzle arrays of color heads so as to simplify logic and driving circuits including the shift register in the printhead.

More specifically, a specific bit, i.e., bit16 (SEL) in printhead driving data shown in FIG. 4 selects the large nozzle arrays or small nozzle arrays by bit logic. The large nozzle arrays or small nozzle arrays are selectively driven on the basis of the state of the bit.

Since the heat pulse signal is common to the large nozzle arrays and small nozzle arrays, it is impossible to select a small nozzle array for one color and a large nozzle array for another color. This is because the heat pulse time is different for the large nozzle array and the small nozzle array. If a heat pulse suitable for a large nozzle array is applied to a small nozzle array, an ink discharge heater corresponding to the small nozzle array may break.

For this reason, a color head that has common driving and heat pulse signals for the large and small nozzle arrays must sequentially toggle-drive the large nozzle array and small nozzle array alternatively so that they can discharge ink during single scanning.

Conventional toggle printing by large nozzle arrays and small nozzle arrays is done for each column, i.e., each nozzle array. FIG. 5 is a view schematically showing a state wherein dots are printed by first driving the nozzles of a large nozzle array and then those of a small nozzle array. Referring to FIG. 5, in driving the nozzles of the large nozzle array, nozzles L0 to L15 are driven in order. Even in driving the nozzles of the small nozzle array, nozzles S0 to S15 are driven in order. The relationship between nozzles and blocks will be described. The nozzle L0 is a nozzle of a block (large block 0) of the large nozzle array. The nozzle L1 is a nozzle of another block (large block 1) of the large nozzle array. The nozzle L15 is a nozzle of still another block (large block 15) of the large nozzle array. The nozzles and blocks of the small nozzle array have the same relationship as in the large nozzle array. In FIG. 5, it looks as if blocks 0 to 15 are driven in order. However, in actual driving, a driving sequence table designates block driving distribution to prevent continuous operation of adjacent blocks.

As shown in FIG. 5, blocks 0 to 15 included in one column within 1,200 dpi drive all nozzles within the driving resolution of the large nozzle array or the small nozzle array. The method of selectively driving each of the large nozzle array and small nozzle array is called "column toggle printing".

Since this method switches print data for each column, the large nozzle array and small nozzle array can share a buffer (to be described later) to latch nozzle data. A large circuit scale is not necessary for column toggle printing.

The number of nozzles of a color head is steadily growing because the market requires a higher print speed even in a high-quality print mode. When the large nozzle array and the small nozzle array are switched for each column, the difference in the amount of ink discharge between the large nozzle array side and the small nozzle array side increases as the number of nozzles increases. FIG. 6 shows the schematic structure of nozzles included in a large nozzle array and a small nozzle array. FIG. 7 is a sectional view taken along a line X.

Referring to FIG. 6, a plurality of nozzles 1 discharge ink. A plurality of ink chambers 2 have openings to the nozzles 1. A long common ink chamber 3 supplies ink to the ink chambers 2. The nozzles are divided into a large nozzle array and a small nozzle array which are arranged on both sides of the common ink chamber 3. In column toggle printing that selectively drives the large nozzle array and the small nozzle array for each column, the amount of the ink discharge on the large nozzle array side and on the small nozzle array side are different. This creates ink imbalances in the common ink chamber 3, and consequently increasin the possibility of hindering ink refill in the ink chambers 2 and causing discharge errors.

SUMMARY OF THE INVENTION

The present invention has been made to solve the above-described problem, and has as its object to provide a printing apparatus, a printing apparatus control method, a printhead control circuit, and a printhead driving method which can increase the printhead discharge stability.

According to the present invention, the foregoing object is attained by providing a printing apparatus for printing on a printing medium by using a printhead which has a first nozzle array including a plurality of nozzles from which a first amount of the ink is discharged and a second nozzle array including a plurality of nozzles from which a second amount of the ink is dischared, comprising:

driving means for time-divisionally driving a plurality of blocks obtained by dividing each of the first nozzle array and the second nozzle array;

selection means for selecting, from the first nozzle array and the second nozzle array, a block to be driven by the driving means within a predetermined period; and control means for controlling the selection means to alternately select a block from the first nozzle array and the second nozzle array and sequentially select a block from each nozzle array in a predetermined order.

In a preferred embodiment, the first nozzle array and the second nozzle array are prepared for each of a plurality of colors, the first nozzle array and the second nozzle array of each of the plurality of colors respectively have a first buffer and a second buffer to store nozzle data to be used for discharge of each nozzle, and the apparatus further comprises holding means for acquiring print data corresponding to each of the first nozzle array and the second nozzle array of each of the plurality of colors and holding the print data in a corresponding buffer as nozzle data.

In a preferred embodiment, the control means causes the selection means to alternately read out nozzle data from each buffer of the first nozzle array and the second nozzle array for each block and supplies the nozzle data to the printhead as driving data of the printhead.

In a preferred embodiment, the control means comprises setting means for setting a driving order of blocks to be driven in the first nozzle array and the second nozzle array, and supplies, to the printhead together with the driving data, information representing a block number that specifies a block corresponding to the driving order set by the setting means.

In a preferred embodiment, the setting means sets the driving order of blocks to be driven in the first nozzle array in a print mode to print by using only the first nozzle array, and sets the driving order of blocks to be driven in the second nozzle array in a print mode to print by using only the second nozzle array.

In a preferred embodiment, the control means comprises count means for counting the number of selected blocks.

In a preferred embodiment, the printhead comprises a common ink chamber to supply a liquid, a first nozzle array which includes first nozzles arrayed in a longitudinal direction of the common ink chamber, a second nozzle array which is arranged in parallel to the first nozzle array and includes second nozzles with a nozzle diameter smaller than a nozzle diameter of the first nozzles, and a plurality of liquid chambers which have openings to the first nozzles and the second nozzles and communicate with the common liquid chamber.

In a preferred embodiment, the printhead comprises a common ink chamber to supply a liquid, a first nozzle array which includes first nozzles arrayed in a longitudinal direction of the common ink chamber, a second nozzle array which includes second nozzles with a nozzle diameter smaller than a nozzle diameter of the first nozzles, and a third nozzle which includes third nozzles with a nozzle diameter smaller than a nozzle diameter of the second nozzles, wherein the fist nozzle array is arranged along with one side of the common ink chamber in a longitudinal direction, and the second and third nozzle arrays are arranged along with the other side of the common ink chamber in a longitudinal direction, the common ink chamber is put in parallel between the first nozzle array, and the second and third nozzle arrays, and the second nozzle and the third nozzle are alternately arranged along with the common ink chamber in a longitudinal direction and are communicated with the common liquid chamber.

In a preferred embodiment, a diameter of the second nozzle is smaller than a diameter of the first nozzle.

According to the present invention, the foregoing object is attained by providing A printing apparatus for printing on a printing medium by using a printhead which has a first nozzle array including a plurality of nozzles from which a first amount of the ink is discharged and a second nozzle array including a plurality of nozzles from which a second amount of the ink is discharged, comprising:

driving means for time-divisionally driving a plurality of blocks obtained by dividing each of the first nozzle array and the second nozzle array;

selection means for selecting, from the first nozzle array and the second nozzle array, a block to be driven by the driving means within a predetermined period; and control means for having a first selection mode for alternately selecting a block from the first nozzle array and the second nozzle array and sequentially selecting a block from each nozzle array in a predetermined order, and a second selection mode for alternately selecting the first nozzle array and the second nozzle array.

According to the present invention, the foregoing object is attained by providing a control method of a printing apparatus for printing on a printing medium by using a printhead which has a first nozzle array including a plurality of nozzles from which a first amount of the ink is discharged and a second nozzle array including a plurality of nozzles from which a second amount of the ink is discharged, comprising steps of:

time-divisionally driving a plurality of blocks obtained by dividing each of the first nozzle array and the second nozzle array;

selecting, from the first nozzle array and the second nozzle array, a block to be driven in the driving step within a predetermined period; and controlling the selecting step to alternately select a block from the first nozzle array and the second nozzle array and sequentially select a block from each nozzle array in a predetermined order.

According to the present invention, the foregoing object is attained by providing a control circuit of a printhead for printing on a printing medium by using a printhead which has a first nozzle array including a plurality of nozzles from which a first amount of the ink is discharged and a second nozzle array including a plurality of nozzles from which a second amount of the ink is discharged, comprising:

driving means for time-divisionally driving a plurality of blocks obtained by dividing each of the first nozzle array and the second nozzle array;

selection means for selecting, from the first nozzle array and the second nozzle array, a block to be driven by the driving means within a predetermined period; and control means for controlling the selection means to alternately select a block from the first nozzle array and the second nozzle array and sequentially select a block from each nozzle array in a predetermined order.

According to the present invention, the foregoing object is attained by providing a driving method of a printhead for printing on a printing medium by using a printhead which has a first nozzle array including a plurality of nozzles from which a first amount of the ink is discharged and a second nozzle array including a plurality of nozzles from which a second nozzle amount of the ink is discharged, comprising steps of:

time-divisionally driving a plurality of blocks obtained by dividing each of the first nozzle array and the second nozzle array;

selecting, from the first nozzle array and the second nozzle array, a block to be driven in the driving step within a predetermined period; and controlling the selection step to alternately select a block from the first nozzle array and the second nozzle array and sequentially select a block from each nozzle array in a predetermined order.

Further features of the present invention will become apparent from the following description of exemplary embodiments with reference to the attached drawings.

BRIEF DESCRIPTION OF THE DRAWINGS

FIG. 12 is a view showing an example of division of nozzle arrays of the printhead according to the embodiment of the present invention;

FIG. 24A to 24C are views for explaining a print mode of the printer according to the embodiment of the present invention.

DESCRIPTION OF THE EMBODIMENT

A preferred embodiment of the present invention will now be described in detail in accordance with the drawings. It should be noted that the relative arrangement of the components, the numerical expressions and numerical values set forth in these embodiments do not limit the scope of the present invention unless it is specifically stated otherwise.

An embodiment of the present invention will be described below in detail with reference to the accompanying drawings.

In this specification, a term "print" not only indicates formation of significant information such as characters and graphics but also broadly includes formation of images, figures, patterns, and the like by supplying a liquid onto a printing medium or processing of the medium, regardless of whether they are significant or insignificant and whether they are so visualized as to be visually perceivable by humans.

Also, a term "printing medium" includes not only a paper sheet used in common printers but also broadly includes materials such as cloth, a plastic film, and a metal plate capable of accepting ink discharged from a printhead.

A term "ink" should be extensively interpreted to be similar to the definition of "print" above. That is, "ink" indicates a liquid which can form images, figures, patterns, and the like when applied to printing medium or can process the printing medium.

Figure 9:
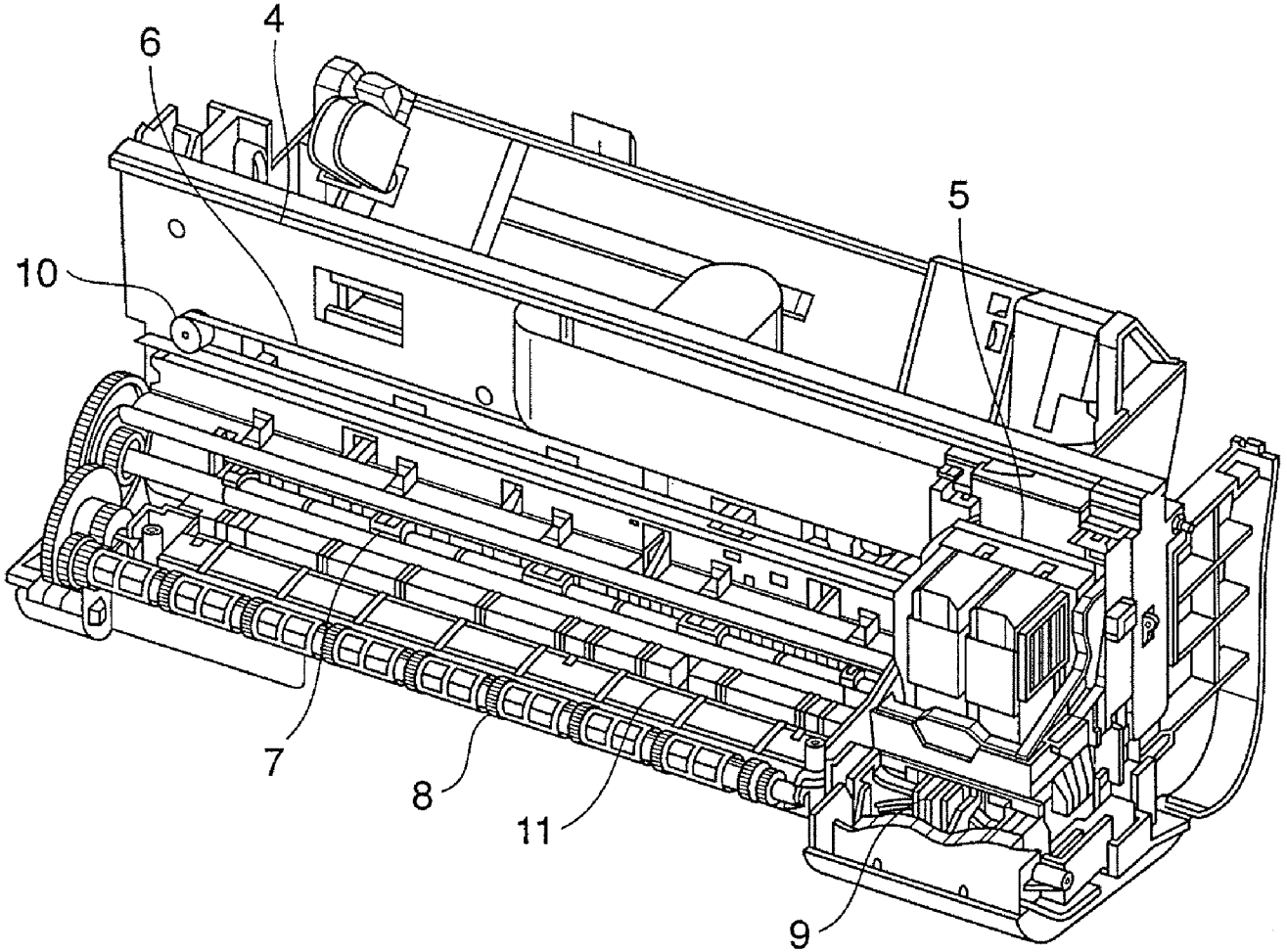
FIG. 9 is a perspective view of an inkjet printer applicable to the embodiment of the present invention.

FIG. 9 is a perspective view of an inkjet printer applicable to the embodiment of the present invention.

The functional components of an inkjet printer 4 (to be referred to as a printer 4 hereinafter) are roughly classified into a carriage 5, timing belt 6, conveyance roller 7, discharge roller 8, cleaning unit 9, carriage motor 10, and platen 11.

The timing belt 6 loops over a pulley attached to the shaft of the carriage motor 10 and a pulley at a symmetrical location. Part of the timing belt 6 connects to the carriage 5 to transmit the driving force of the carriage motor 10. The discharge roller 8 is set to rotate at a slightly higher speed than the conveyance roller 7 to apply a proper tension to a printing medium on the platen 11.

The back-side structure of the carriage 5 will be described next with reference to FIG. 10.

Figure 10:
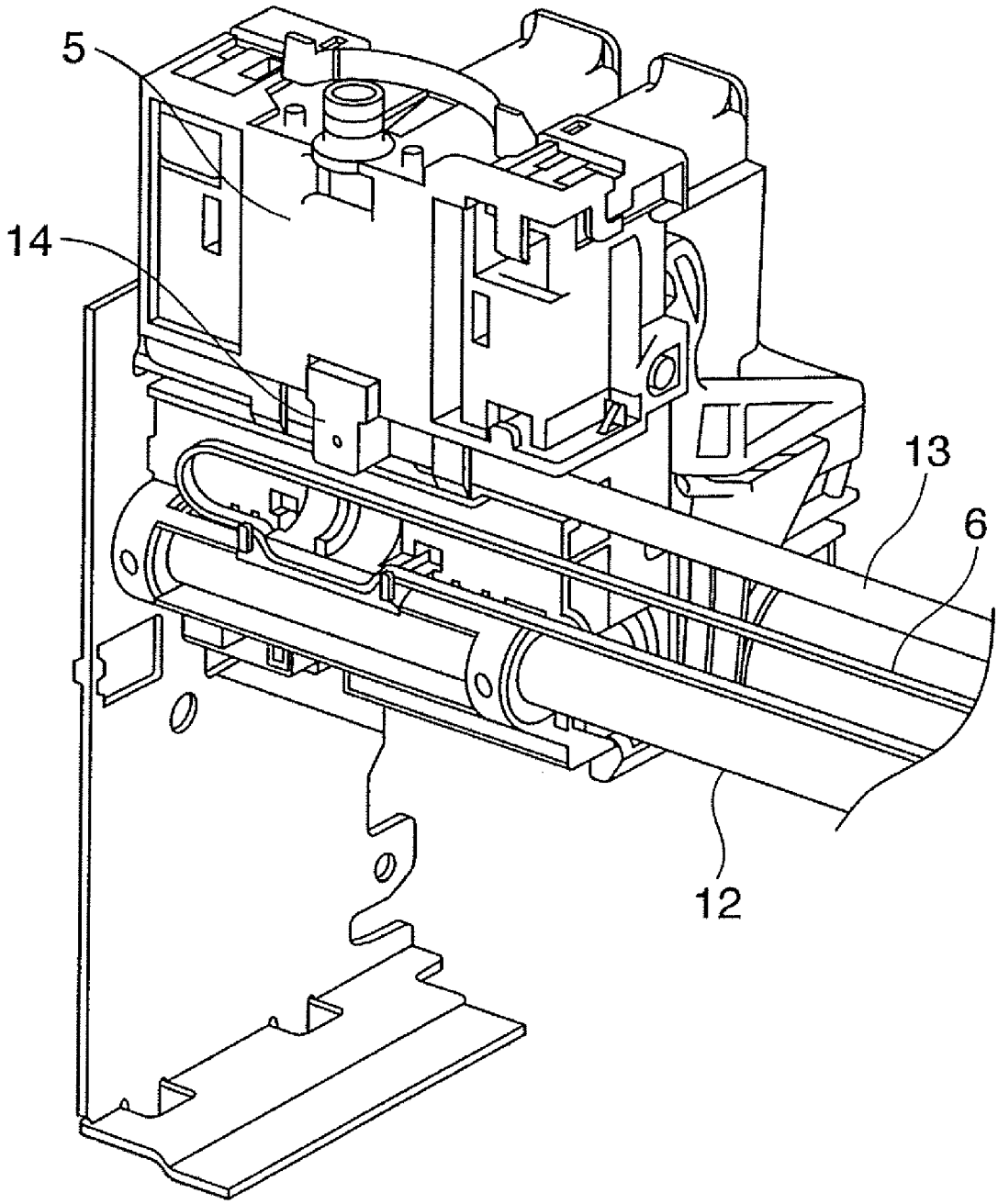
FIG. 10 is a perspective view showing the back-side structure of a carriage according to the embodiment of the present invention.

FIG. 10 is a perspective view showing the back-side structure of the carriage according to the embodiment of the present invention.

The carriage 5 is supported by a shaft 12 so as to move in the horizontal direction. An encoder 14 to read a scaler 13 is arranged on the back side of the carriage 5.

The encoder 14 reads the scaler 13 running across the printer 4 as the carriage 5 moves. The printer 4 constantly monitors the displacement amount of the carriage 5 by the encoder 14 and performs feedback control of the carriage motor 10 on the basis of that information. Timing information for driving the printhead mounted on the carriage 5 is also generated on the basis of the position information of the encoder 14.

A control circuit to control various kinds of operations of the printer 4 will be described next with reference to FIG. 11.

Figure 11:
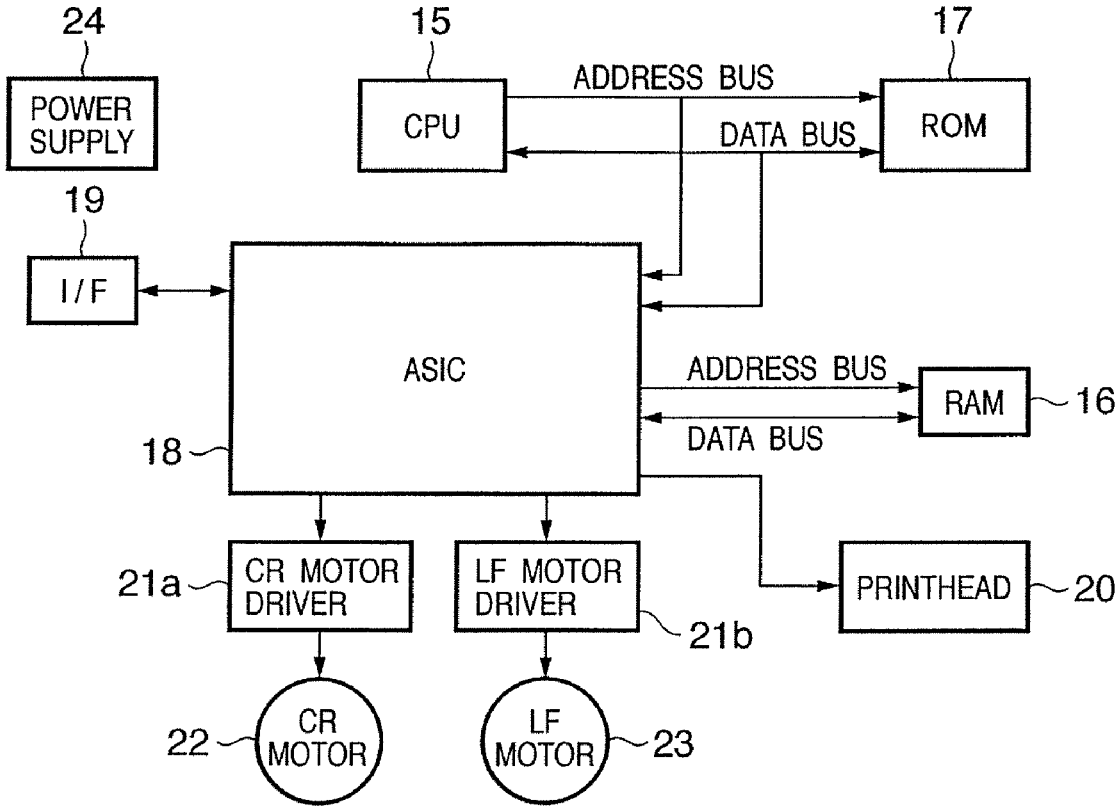
FIG. 11 is a block diagram showing the overall arrangement of the control circuit of the printer according to the embodiment of the present invention.

FIG. 11 is a block diagram showing the overall arrangement of the control circuit of the printer according to the embodiment of the present invention.

The main components of the printer 4 include a CPU 15, RAM 16, ROM 17, ASIC 18, interface (I/F) 19, printhead 20, and power supply 24.

FIG. 11 illustrates the elements as discrete components. Instead, all the elements may be integrated into one LSI package.

The ROM 17 has a program area that stores various kinds of programs to control the printer 4. This program area stores the firmware of the printer 4 and the motor driving table.

The ASIC 18 controls not only motor driving but also image processing, communication with a host computer via the interface (I/F) 19, and ink discharge from the printhead 20.

The RAM 16 functions as a receive buffer to temporarily save data received from the host computer. The RAM 16 also serves as a work area used by the ASIC 18 as a temporarily memory for image processing and a scroll print buffer to save print data. The driving data table to control driving of the motor is bitmapped in the work area.

Motor drivers to drive various motors of the printer 4 include two motors: a CR motor driver 21*a* for driving the carriage (CA) and an LF motor driver 21*b* for sheet conveyance (LF). The carriage (CR) motor 22 and sheet conveyance (LF) motor 23 are driven by the corresponding motor drivers.

The combination of motor drivers and motors in FIG. 11 is merely an example. The number of motors and the number of motor drivers can be changed depending on the printer. The motor drivers 21*a* and 21*b* may be integrated into one IC package.

The power supply 24 generates, from a commercial power, a logic power for driving semiconductor devices, a power for driving the motors, and a power for driving the head. Voltage conversion units (DC/DC converters) in the CR motor driver 21*a* and LF motor driver 21*b* may partially perform voltage conversion (DC/DC converter) of the DC power generated by the power supply 24.

Figure 3:
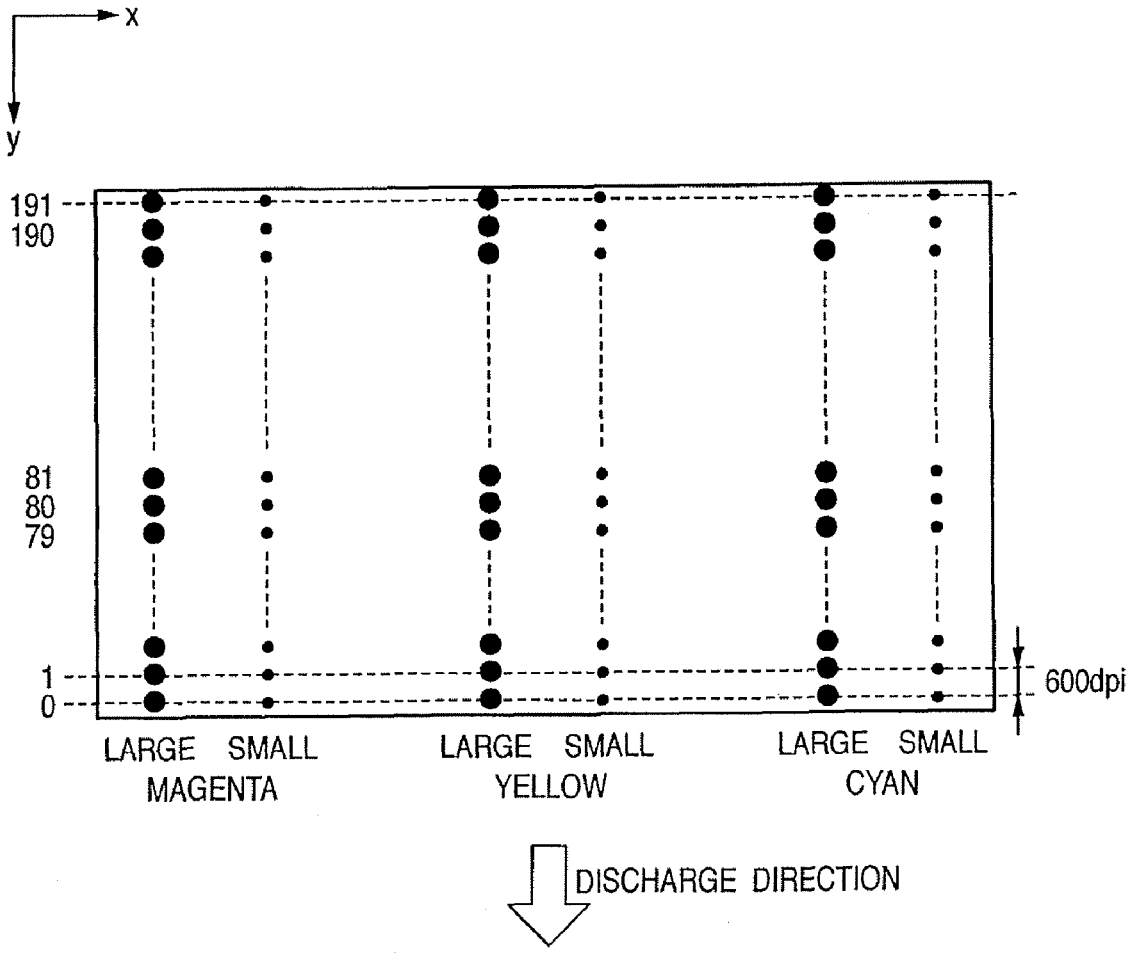
FIG. 3 is a view showing a nozzle layout arrangement of a color head.

In a method generally used to drive the printhead 20, the plurality of nozzles arrayed in lines in the column direction (y direction) in FIG. 3 are divided into several nozzle groups which are driven at different timings (time-divisional drive). For example, the above-described Japanese Patent Laid-Open No. 2000-071433 describes this method in detail. The time-divisional drive of nozzles allows for an increase in the ink supply speed and stability, and for reduction in the power consumption necessary for discharge.

Figure 23:
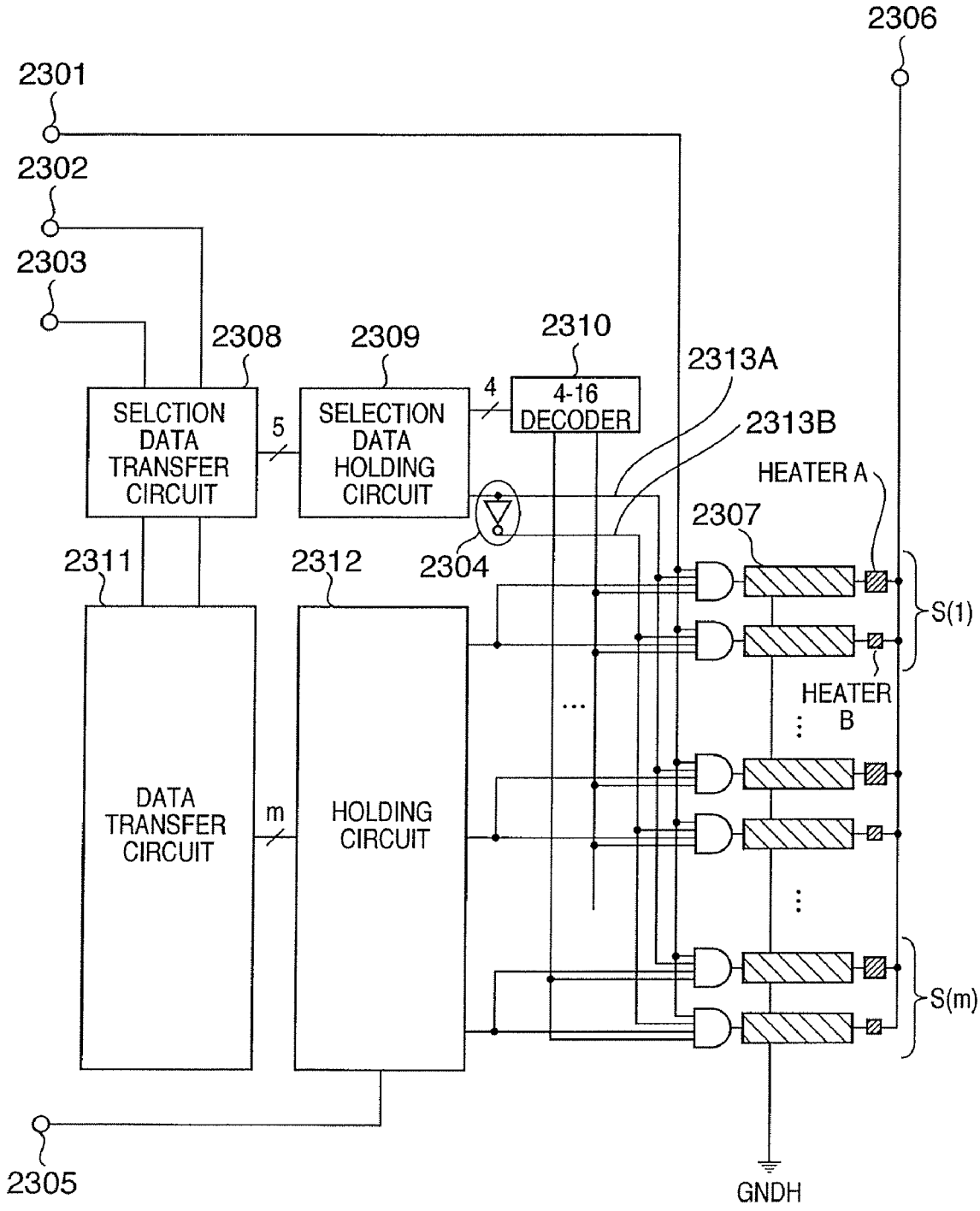
FIG. 23 is a view for explaining a printhead control block according to the embodiment of the present invention.

The internal structure (a control circuit) of the printhead 20 will be described with reference to FIG. 23. A heater driving signal is input from a terminal 2301. A clock signal is input from a terminal 2302. Voltage applied to a heater is input from a terminal 2306. "m" (for example m=12) numbers nozzles are driven simultaneously by the heater driving signal. As shown in FIG. 23, a heater A for large nozzles and a heater B for small nozzles are comprised by groups S(1) to S(m). A driving circuit 2307 drives the heater A and the heater B.

Figure 14:
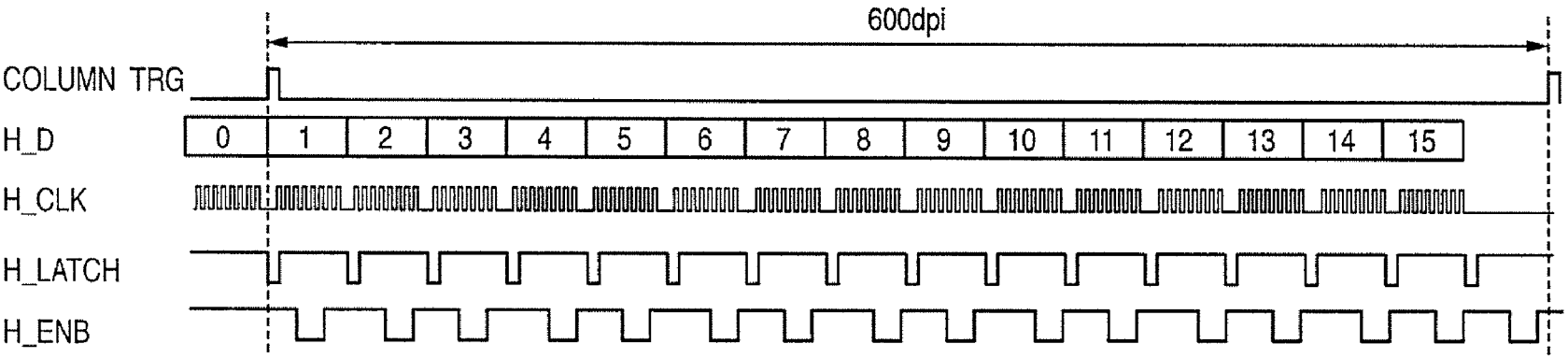
FIG. 14 is a timing chart showing the drive timing of the printhead according to the embodiment of the present invention.

A selection data holding circuit 2039 outputs a signal 2313A in correspondence with the value of BE4 (L/S) in FIG. 14. An inverting circuit 2304 inverts the signal 2313A into a signal 2313B. One of heaters A and B is driven by these signals 2313A and 2313B.

The nozzle array will be described. In case of cyan nozzle array, this array has 16 groups of nozzles. Accordingly, m×16 of the heaters A are comprised for the large nozzle array and m×16 of the heaters B are comprised for the small nozzle array. For each nozzle arrays, "m" numbers of nozzles are not adjacent each other. A nozzle in one group is adjacent to a nozzle in the other group.

Data is input from a terminal 2303 in synchronism with a clock signal. Of the input data, selection data is sent to a selection data transfer circuit 2308, and image data is sent to a data transfer circuit 2311. The selection data from the selection data transfer circuit 2308 is held by a selection data holding circuit 2309 and decoded by a decoder 2310. The selection data holding circuits holds the selection data on the basis of a latch signal input from an input terminal 2305.

The decoder 2310 selects one of 16 groups on the basis of a signal output from the selection data holding circuit 2309.

The image data is m bit data. The image data from the data transfer circuit 2311 is held by a holding circuit 2312 and is output to nozzle groups S(1) to S(m).

In the above-described arrangement, the control circuit executes switch on the basis of control signal so as to sequentially select each block for simultaneously discharging nozzles while the control circuit alternately selects between a block of the large nozzle array and a block of the small nozzle array.

Figure 25:
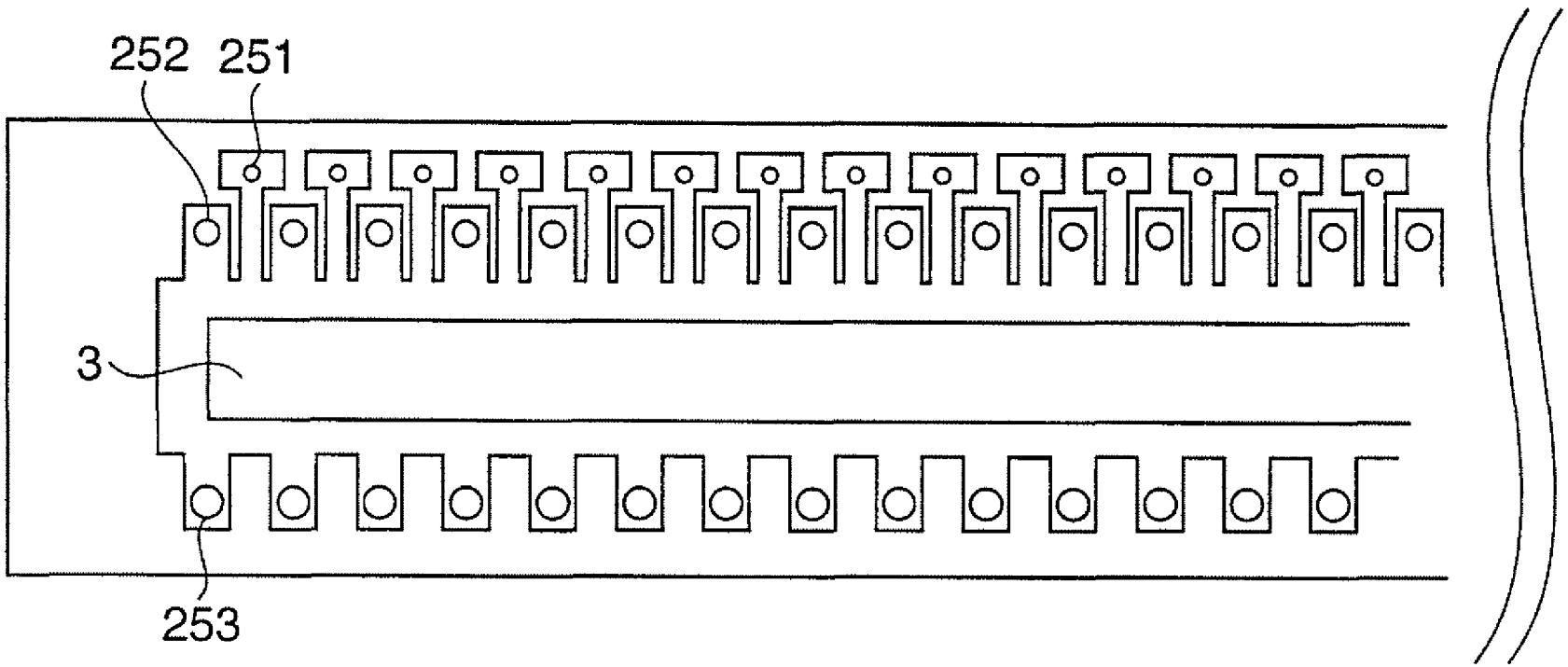
FIG. 25 is a view schematically arrangement of nozzles of the printhead in the discharge direction according to the other embodiment of the present invention.

In this arrangement of the control circuit, it is not limited to a case of a block of large nozzle array and a block of small nozzle array. This control circuit of the present invention can be applied to a case of a block of small nozzle array and a block of middle nozzle array. For example, the control circuit of the present invention can be applied to an arrangement as shown in FIG. 25, that is, a first nozzle array of large nozzles 253 is arranged along with one side of a common ink chamber 3 in a longitudinal direction, and a second nozzle array of the middle nozzles 252 and a third nozzle array of the small nozzles 251 are arranged along with the other side of the common ink chamber 3 in a longitudinal direction. In this arrangement, the common ink chamber is put in parallel between the first nozzle array, and the second and third nozzle arrays, and a small nozzle 251 and a middle nozzle 252 are alternately arranged along with the common ink chamber 3 in a longitudinal direction.

The control circuit alternately selects between a block of the small nozzles 251 and a block of the middle nozzles 252. Further, a control circuit for a block of large nozzles 253 is separately comprised other than the control circuit for a block of the small nozzles 251 and a block of the middle nozzles 252.

The host computer generates print data to implement print control of the control circuit and controls output of the print data to the printer. For example, a dedicated program such as a printer driver which is installed in the host computer in correspondence with printer 4 implements the print data generation/output control. However, dedicated hardware to implement the processing executed by the dedicated program may implement the print data generation/output control.

The host computer has standard constituent elements mounted on a general-purpose computer such as a personal computer (including various kinds of computers such as a notebook computer and desktop computer). The constituent elements include, e.g., a CPU, RAM, ROM, hard disk, external storage device, network interface, display, keyboard, and mouse.

The host computer can be not only a personal computer but also a digital camera or a portable terminal such as a portable phone or PDA.

An example of division of nozzle arrays for time-divisional drive of the printhead 20 will be described next with reference to FIG. 12.

FIG. 12 is a view showing an example of division of nozzle arrays of the printhead according to the embodiment of the present invention.

FIG. 12 shows, in a table format, the nozzle arrangement of each of 16 divided blocks of a color nozzle array. As shown in FIG. 12, 12 nozzles on intervals of 16 nozzles belong to the same block. That is, nozzles at intervals of 16 nozzles belong to the same block. When each block includes nozzles arranged at a predetermined interval, it is possible to minimize the influence of the driving of adjacent nozzles.

A printhead control block to drive the printhead 20 will be described next. The printhead control block is one block of the ASIC 18. This will be described with reference to FIG. 13.

Figure 13:
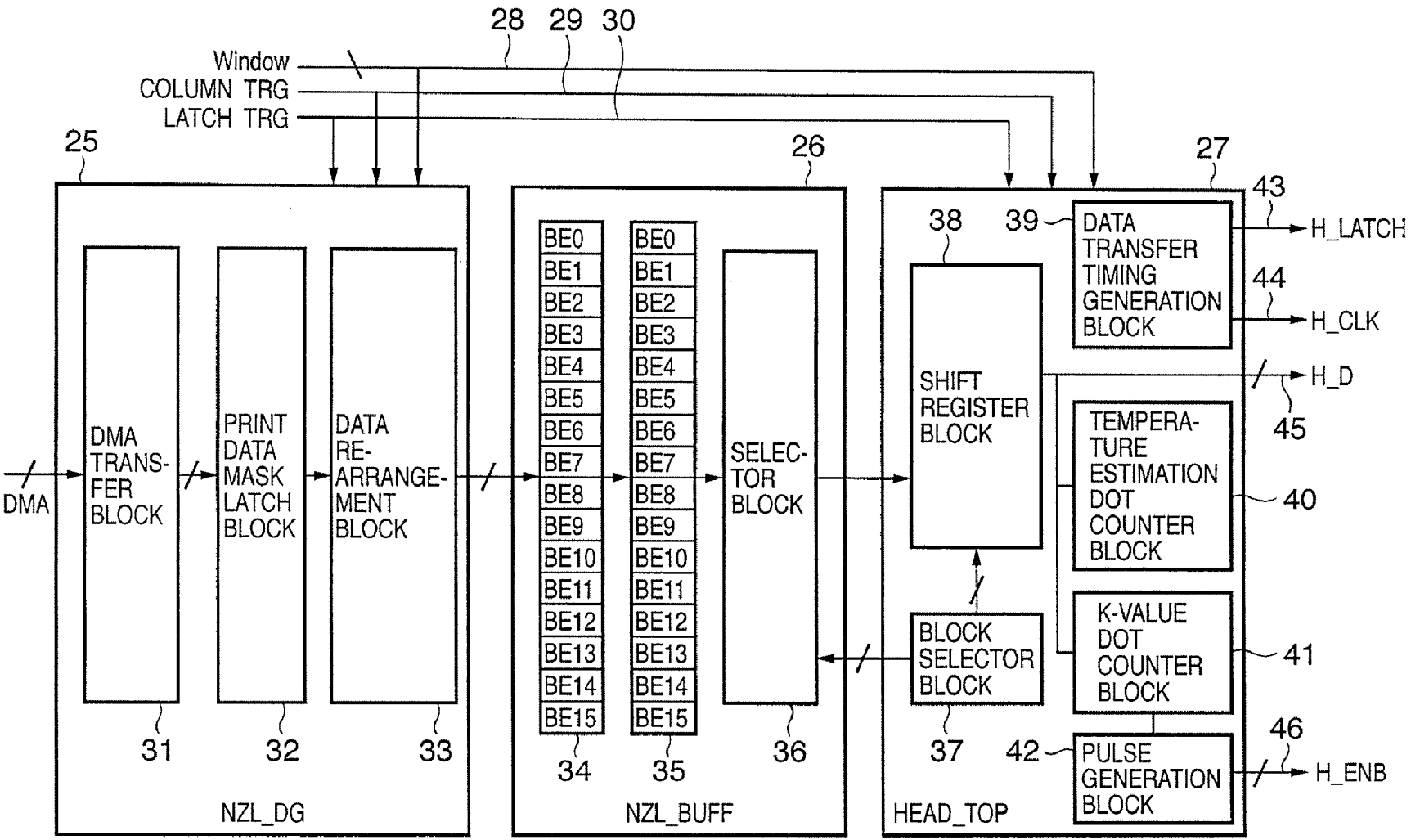
FIG. 13 is a block diagram showing a printhead control block according to the embodiment of the present invention.

FIG. 13 is a block diagram showing the printhead control block according to the embodiment of the present invention.

As is apparent from FIG. 13, the printhead control block roughly includes three blocks: nozzle data generation block (NZL_DG) 25, nozzle data holding block (NZL_BUFF) 26, and printhead control block (HEAD_TOP) 27.

Reference timing signals to drive the nozzle data generation block 25 and printhead control block 27 are generated on the basis of position information acquired from an encoder signal (not shown) and supplied from a discharge timing generation block (not shown) as print timing signals. The print timing signals include a Window 28, Column TRG 29, and Latch TRG 30.

For the Window 28, a flag is set (Window Open) when the carriage 5 moves in the raster direction (main scanning direction) and arrives at a print designation point. The flag is cleared (Window Close) at a print end position. The number of control signal bits of the Window 28 corresponds to the number of nozzle arrays of the printhead 20.

For example, assume that a black printhead includes two nozzle arrays, i.e., Odd/Even nozzle arrays, and a color printhead includes six nozzle arrays, i.e., Cyan Large, Cyan Small, Magenta Large, Magenta Small, Yellow Large, and Yellow Small nozzle arrays.

The Large/Small nozzle arrays of a color printhead incapable of simultaneously driving the Large nozzle array and Small nozzle array are generally controlled by the same Window signal bit.

The black printhead uses two Window signal bits, and the color printhead uses three Window signal bits. That is, a total of five Window signal bits are used.

The Column TRG 29 is a trigger signal (column trigger) output at a column interval. The interval of this signal corresponds to the print resolution in the raster direction, i.e., the main scanning direction.

The Latch TRG 30 is generated at a timing obtained by uniformly dividing the column interval by the number of blocks. This timing is the switching timing of time-divisional drive. When 16 blocks of nozzle arrays are present as in this embodiment, 16 signals Latch TRG 30 are generated in one column time.

The nozzle data generation block (NZL_DG) 25 includes a DMA (Direct Memory Access) transfer block 31, print data mask latch block 32, and data rearrangement block 33.

The DMA transfer block 31 receives print data rasterized on the RAM 23 by DMA transfer. If all nozzles of one color nozzle array shown in FIG. 3 are used, data corresponding to 16 (bit)×12 (number of times of DMA)=192 (bit) is received. The number of times of DMA changes depending on the number of nozzles to be used.

The print data mask latch block 32 has a function of latching the print data acquired by DMA transfer in correspondence with the nozzle position and setting, on the basis of register information (not shown), a mask (nozzle mask) on nozzles that are not to be used. A nozzle mask can be set for each nozzle.

The data rearrangement block 33 rearranges print data on the basis of the print nozzle blocks. That is, the data rearrangement block 33 rearranges print data to the nozzle data arrays of the blocks on the basis of nozzle information that forms the blocks shown in FIG. 12.

Main signals to activate the nozzle data generation block (NZL_DG) 25 include a combination of the Window 28 and Column TRG 29. That is, print data arrives at a print designation point, and a flag is set by the Window 28. Upon receiving the Column TRG 29, acquisition of print data starts. When the Window 28 closes, acquisition of print data stops.

The nozzle data holding block (NZL_BUFF) 26 is a buffer to hold nozzle data having the block arrangement shown in FIG. 12.

The data array coincides with the nozzle array of each block of the printhead 20 to facilitate data management and, by this, facilitate print driving data generation by the printhead 20.

The buffer of the nozzle data holding block (NZL_BUFF) 26 includes two stages: a first buffer 34 and a second buffer 35. Each buffer holds data for one column of all nozzle arrays.

A black nozzle array has a data amount of 10 (bit)×16 (block)=160 (bit). A color nozzle array has a data amount of 12 (bit)×16 (block)=192 (bit).

This buffer has the two-stage structure to transfer each block data in one column to the printhead 20 while preparing the data for the next column. The first buffer 34 is on the write side, and the second buffer 35 is on the read side.

A selector block 36 successively selects a block and outputs nozzle data of the block on the basis of a block selection signal from a block selector block 37 of the printhead control block (HEAD_TOP) 27.

The bus width of nozzle data is 16 bits. Color nozzle data are assigned to all the 16 bits. Black nozzle data contains only 10 bits. Hence, data "0" is set for upper two bits. Both the black nozzle data and color nozzle data have the same bus width to share the circuits of the printhead control block (HEAD_TOP) 27.

The printhead control block (HEAD_TOP) 27 includes the block selector block 37, shift register block 38, data transfer timing generation block 39, and temperature estimation dot counter block 40. The printhead control block (HEAD_TOP) 27 also includes a K-value dot counter block 41 and a pulse generation block 42.

The printhead control block (HEAD_TOP) 27 outputs driving signals H_LATCH 43, H_CLK 44, H_D 45, and H_ENB 46 of the printhead 20.

The Window 28, Column TRG 29, and Latch TRG 30 activate the printhead control block (HEAD_TOP) 27.

The block selector block 37 outputs a block selection signal to the selector block 36 of the nozzle data holding block (NZL_BUFF) 26 in accordance with the block order by the trigger signal Latch TRG 30 for time-divisional drive of the printhead 20. Simultaneously, the block selector block 37 outputs the block selection signal to the shift register block 38.

Figure 4:
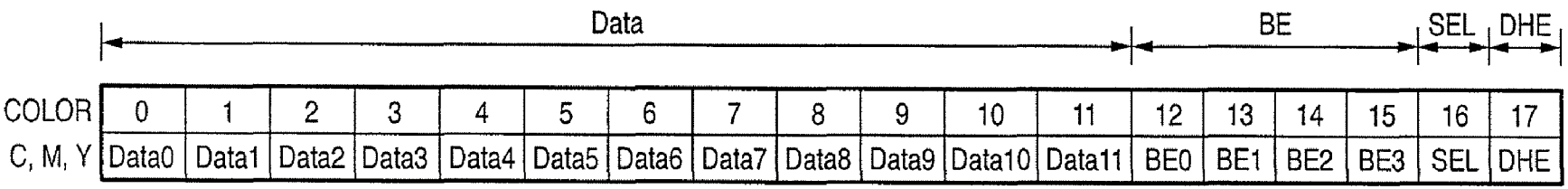
FIG. 4 is a view showing a structure example of printhead driving data.

The shift register block 38 causes a shift register to convert the nozzle data and block selection signal output from the nozzle data holding block (NZL_BUFF) 26 into serial data and outputs the data as the printhead driving data H_D 45. For the black printhead, two driving signal bits are necessary because it has two nozzle arrays, i.e., EVEN and ODD nozzle arrays. For the color printhead, three driving signal bits are used because the large nozzle arrays or small nozzle arrays are selected by bit16 (SEL) of the printhead driving data shown in FIG. 4. Hence, the printhead driving data H_D 45 contains a total of five signal bits.

A large nozzle and a small nozzle differ in amount of ink discharged at a time. That is, a nozzle with a relatively large ink amount is a large nozzle. A nozzle with a relatively small ink amount is a small nozzle. Each of the large and small nozzles are normally formed from a round nozzle. For example, assume that a first nozzle is a large nozzle. A first nozzle diameter as a diameter indicating the representative nozzle diameter of the first nozzles is larger than a second nozzle diameter of a small nozzle serving as a second nozzle. That is, first nozzle diameter>second nozzle diameter. In this embodiment, a nozzle having the first nozzle diameter will be referred to as a large nozzle, and a nozzle having the second nozzle diameter will be referred to as a small nozzle for the descriptive convenience.

The nozzle shape is not limited to circular. A nozzle can have any other shape such as a star or elliptic shape. In this case, a diameter regarded as the representative diameter of a circumscribed circle of the shape is defined as the nozzle diameter. For example, if the nozzle shape is elliptic, the major axis is defined as the nozzle diameter.

The data transfer timing generation block 39 generates the transfer clock H_CLK 44 to transfer the printhead driving data H_D 45 to the printhead 20 on the basis of the Latch TRG 30. The data transfer timing generation block 39 also generates the latch signal H_LATCH 43 to latch data in the shift register in the printhead 20. The data transfer timing generation block 39 outputs a data shift timing signal to the shift register block 38.

The temperature estimation dot counter block 40 and K-value dot counter block 41 are arithmetic blocks to correct, in accordance with the nozzle discharge frequency, the driving pulse width of the heat enable signal H_ENB 46 generated by the pulse generation block 42.

The temperature estimation dot counter block 40 is used to change the correction table at an interval of several ten ms. The K-value dot counter block 41 corrects the optimum heat pulse width of the next block on the basis of the heat state by the nozzle discharge frequency of the preceding block with reference to the Latch TRG 30 (this correction control will be referred to as K-value control hereinafter).

The heat enable signal H_ENB 46 contains one signal bit for black and two signal bits for a color. The two signal bits are assigned to a color to distribute the energy necessary for discharge by shifting the heat timing.

The drive timing of the printhead 20 will be described next with reference to FIG. 14.

FIG. 14 is a timing chart showing the drive timing of the printhead according to the embodiment of the present invention.

Especially, FIG. 14 shows the printhead drive timing per column.

Referring to FIG. 14, the Column TRG 29 is an internal signal. The H_LATCH 43, H_CLK 44, H_D 45, and H_ENB 46 are printhead driving signals. As shown in FIG. 14, one column includes 16 blocks which are time-divisionally driven.

The printhead driving data H_D 45 is transferred to the shift register in the printhead 20 in accordance with the transfer clock H_CLK 44 and latched at the trailing edge of the H_LATCH 43. The latched printhead driving data causes discharge by the heat pulse of the heat enable signal H_ENB 46 of the next block. In addition, data transfer for the next drive is done.

The relationship between the transfer clock H_CLK 44 and the printhead driving data H_D 45 will be described next with reference to FIG. 15.

Figure 15:
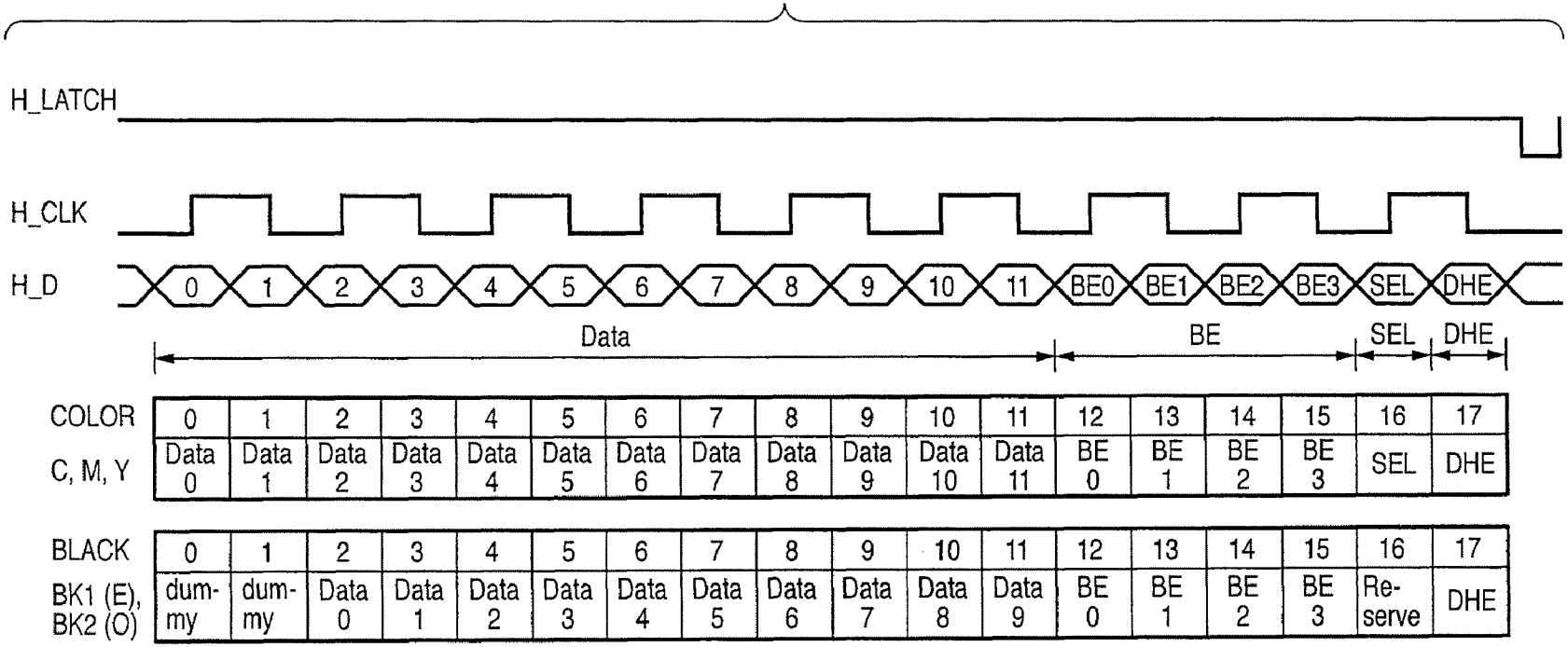
FIG. 15 is a timing chart showing the relationship between a transfer clock and printhead driving data according to the embodiment of the present invention.

FIG. 15 is a timing chart showing the relationship between the transfer clock and the printhead driving data according to the embodiment of the present invention.

The printhead driving data H_D 45 enables data transfer at both the edges of the transfer clock H_CLK 44. The frequency of the transfer clock H_CLK 44 is about 6 MHz to 12 MHz.

The printhead driving data H_D 45 contains nozzle data from bit0 to bit11. The nozzle data contains 10 bits of bit2 to bit11 for black and 4 bits from bit0 to bit11 for a color. Four bits from bit12 to bit15 correspond to block selection data BLE. A driving block is selected in the printhead 20 on the basis of the 4-bit block selection data BLE to implement time-divisional drive.

Bit16 corresponds to heater switching data SEL to select the large nozzle array or small nozzle array of a color head. The large nozzle array causes a nozzle to discharge ink of about 5 pl. The small nozzle array causes a nozzle to discharge ink of about 2 pl. Bit17 corresponds to a dummy nozzle selection bit (DHE). When the dummy nozzle selection bit (DHE) is enabled, a number of dummy nozzles arranged at the top and end of a nozzle array can discharge ink. The dummy nozzles are provided to discharge the ink staying at the corners of the ink chambers upon preliminary discharge of the printhead 20.

Detailed Description of Embodiment

Toggle printing by the large nozzle arrays and small nozzle arrays of, e.g., a printhead with three colors has the following restriction. When each of cyan, magenta, and yellow has a large nozzle array and a small nozzle array, a specific designation bit of print data selects the large nozzle array or small nozzle array, and a common heat pulse signal is used. It is therefore impossible to simultaneously drive the large nozzle array and small nozzle array.

In a conventional print mode, the large nozzle array and small nozzle array are toggle-switched for each column to execute printing by individually using the large nozzles and small nozzles in one scanning. In the conventional column toggle printing to execute toggle printing for each column, nozzle data for a small nozzle array and that for a large nozzle array are acquired for each column at different timings. This allows to commonly use the nozzle data holding block (NZL_BUFF) 26 for the small nozzle array and large nozzle array.

Figure 8:
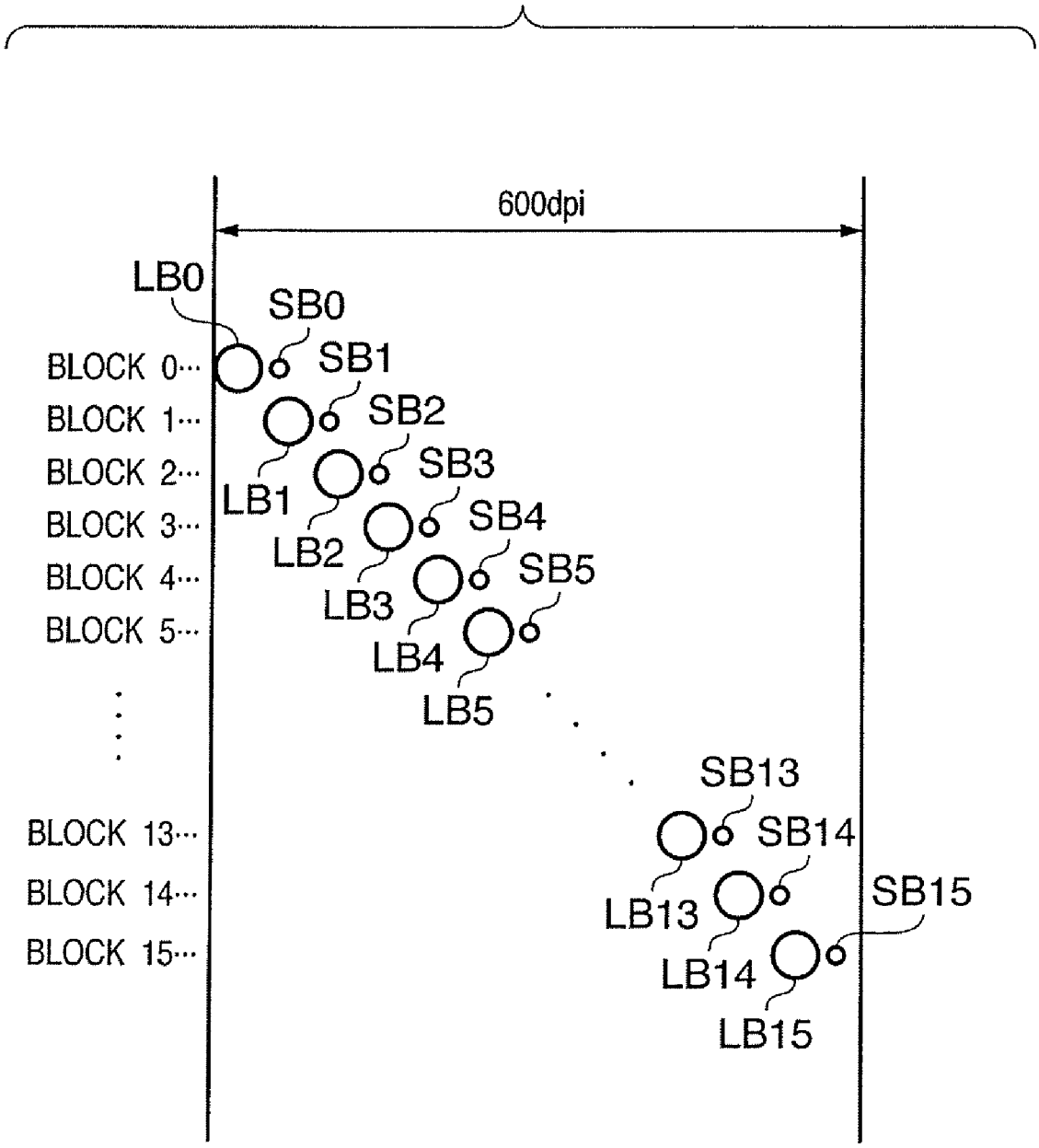
FIG. 8 is a view schematically showing distributed driving of block toggle printing by large nozzles and small nozzles according to an embodiment of the present invention.

In toggle printing by a large nozzle array and a small nozzle array as a characteristic feature of the present invention, the large nozzle array and small nozzle array are alternately driven for each block, as indicated by the discharge state shown in FIG. 8. For the descriptive convenience, FIG. 8 illustrates driving of nozzles 0 (LB0 of the large nozzle array and SB0 of the small nozzle array) to nozzles 15 (LB15 of the large nozzle array and SB15 of the small nozzle array). In FIG. 8, dots are printed from left to right. For example, LB0 (block 0) is driven, and then, SB0 (block 0) is driven. Next, LB1 (block 1) is driven, and then, SB1 (block 1) is driven. Block 2, block 3, . . . are sequentially driven. Finally, SB15, i.e., a small nozzle of last block 15 is driven. In this way, one column of the large nozzle array and that of the small nozzle array are printed in an interval of 600 dpi by time-divisionally driving the 32 blocks.

This printing method will be referred to as "block toggle printing".

As a characteristic feature of this embodiment, two kinds of nozzle buffers, i.e., a nozzle buffer for a large nozzle array and that for a small nozzle array are prepared for each color to implement this printing method. A color head with, e.g., three colors has nozzle buffers for the small nozzle arrays of cyan, magenta, and yellow in addition to conventional nozzle buffers for the three colors. That is, the printhead has a total of six nozzle buffers.

Six color print data are acquired for the large nozzle arrays and small nozzle arrays at a time interval corresponding to 600 dpi as print data to be converted into nozzle data. The print data are rearranged for the nozzle groups of blocks and saved in the nozzle buffers.

In driving the printhead, 32 blocks are driven within a ½ resolution (i.e., 600 dpi) by using two column sections at a time interval corresponding to a predetermined resolution (e.g., 1,200 dpi). The printhead 20 is driven by alternately selecting nozzle data from the nozzle buffer for the large nozzle array and that for the small nozzle array at a block driving period, thereby driving the 32 blocks.

The blocks are driven in the order of the large nozzle array and small nozzle array. Each nozzle array can individually set the order of blocks 0 to 15.

This allows to change the block position between the large nozzle array and the small nozzle array driven at the next timing. More specifically, when driving starts from a large nozzle block, the large nozzle array is driven at even-numbered timings, i.e., 0, 2, 4, 6, 8, . . . , 30 in the 32 blocks. The small nozzle array is driven at odd-numbered timings, i.e., 1, 3, 5, . . . , 31 in the 32 blocks.

It is possible to selectively drive blocks of the large nozzle array at even-numbered drive timings and blocks of the small nozzle array at odd-numbered drive timings in an arbitrary block driving order. If driving starts from a small nozzle, the small nozzle array is driven at odd-numbered timings, and the large nozzle array is driven at even-numbered timings.

Since nozzle array driving is switched for each block, the heat pulse signal is also toggle-switched to generate a heat pulse for a large nozzle and that for a small nozzle.

The above-described characteristic feature of this embodiment will be described below in more detail.

The arrangement of the nozzle data holding block (NZL_BUFF) 26 that functions as a nozzle buffer will be described with reference to FIG. 16.

Figure 16:
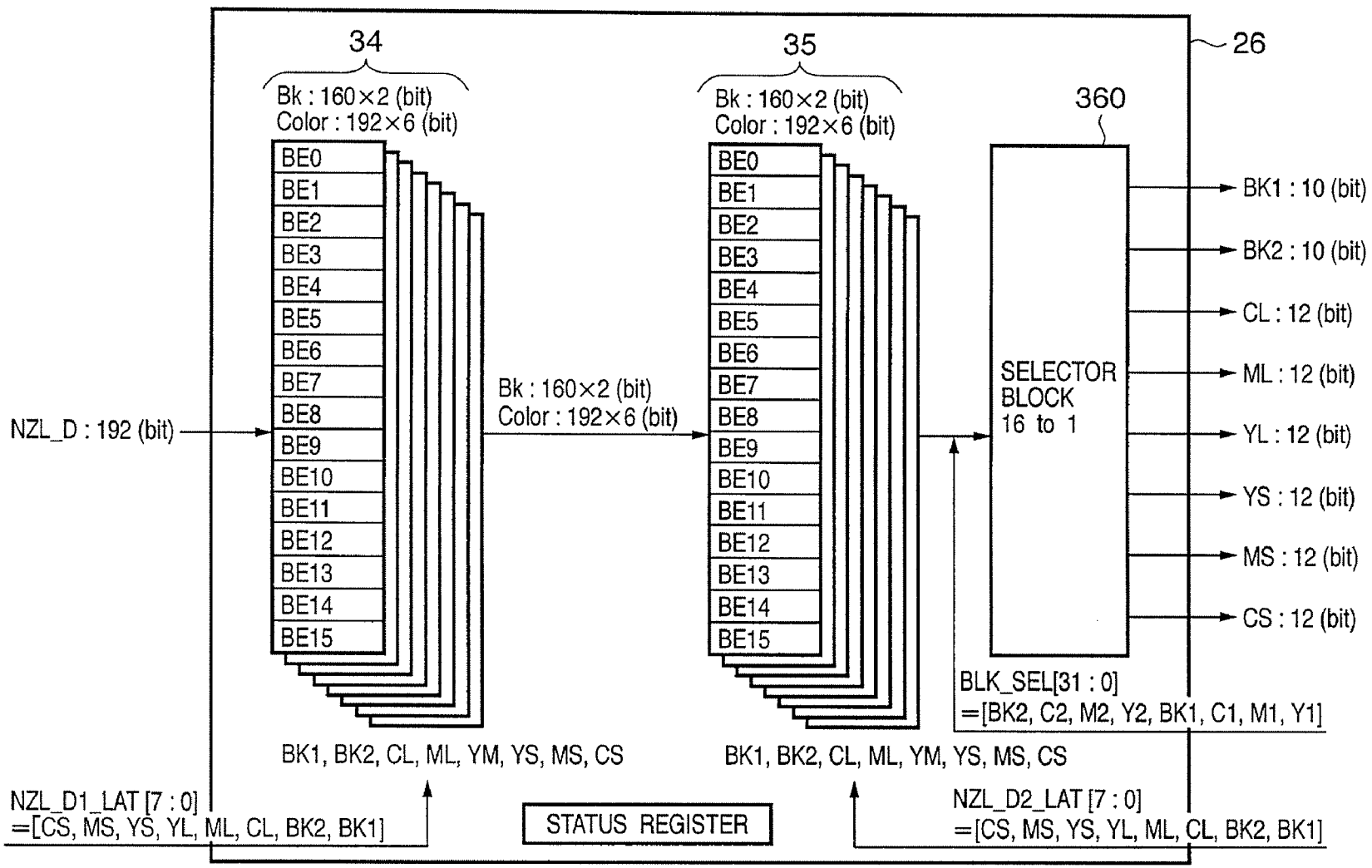
FIG. 16 is a view showing a detailed arrangement of a nozzle data holding block according to the embodiment of the present invention.

FIG. 16 is a view showing a detailed arrangement of the nozzle data holding block according to the embodiment of the present invention.

A color head with three colors, i.e., Cyan, Magenta, and Yellow has nozzle buffers for the small nozzle arrays in addition to conventional nozzle buffers for the three colors. That is, the printhead has a total of six nozzle buffers. The conventional nozzle buffers serve as nozzle buffers for the large nozzle arrays.

Referring to FIG. 16, CL, CS, ML, MS, YL, and YS correspond to a Cyan Large, Cyan Small, Magenta Large, Magenta Small, Yellow Large, and Yellow Small nozzle buffers, respectively. As shown in FIG. 16, the First Latch (first buffer 34) and Second Latch (second buffer 35) are also prepared for each nozzle array.

Figure 17:
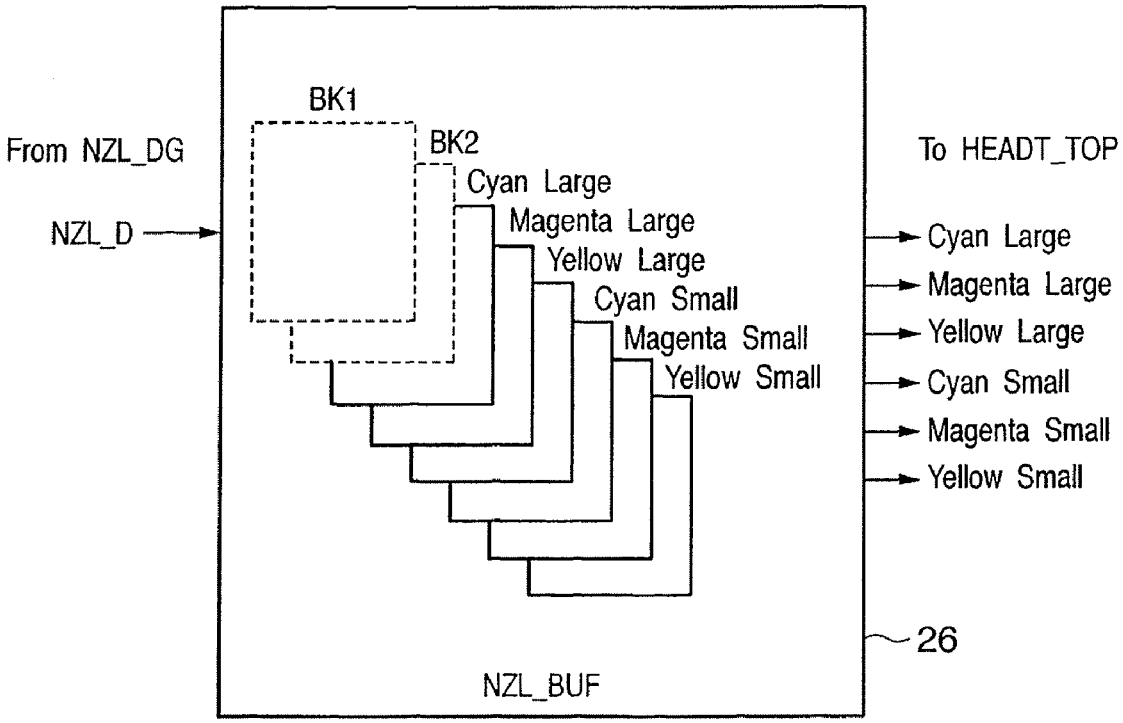
FIG. 17 is a view for explaining a nozzle buffer using method in block toggle printing by large nozzles and small nozzles according to the embodiment of the present invention.

FIG. 17 schematically shows the nozzle buffer arrangement in FIG. 16.

FIG. 17 schematically illustrates the buffer structure for each nozzle array assuming that the First Latch and Second Latch have identical planes.

To implement block toggle printing of the present invention, buffers are prepared for the large nozzle array and small nozzle array of each color. The buffers of planes indicated by solid lines in FIG. 17 are buffers to be used, and those of planes indicated by dotted lines are buffers not to be used.

The buffer usage shown in FIG. 17 applies to a print mode that executes not black printing but only color printing by block toggle driving. Nozzle data of a print block is output in response to a nozzle data request from the printhead control block (HEAD_TOP) 27.

In block toggle printing, a total of 32 blocks including large nozzles and small nozzles are driven in an interval of 600 dpi to print, as shown in FIG. 8. It is therefore necessary to prepare data for a large color nozzle array and that for a small color nozzle array at an interval of 600 dpi. The nozzle data in the nozzle buffer of the large color nozzle array and that of the small color nozzle array shown in FIG. 17 are updated at an interval of 600 dpi.

Figure 18:
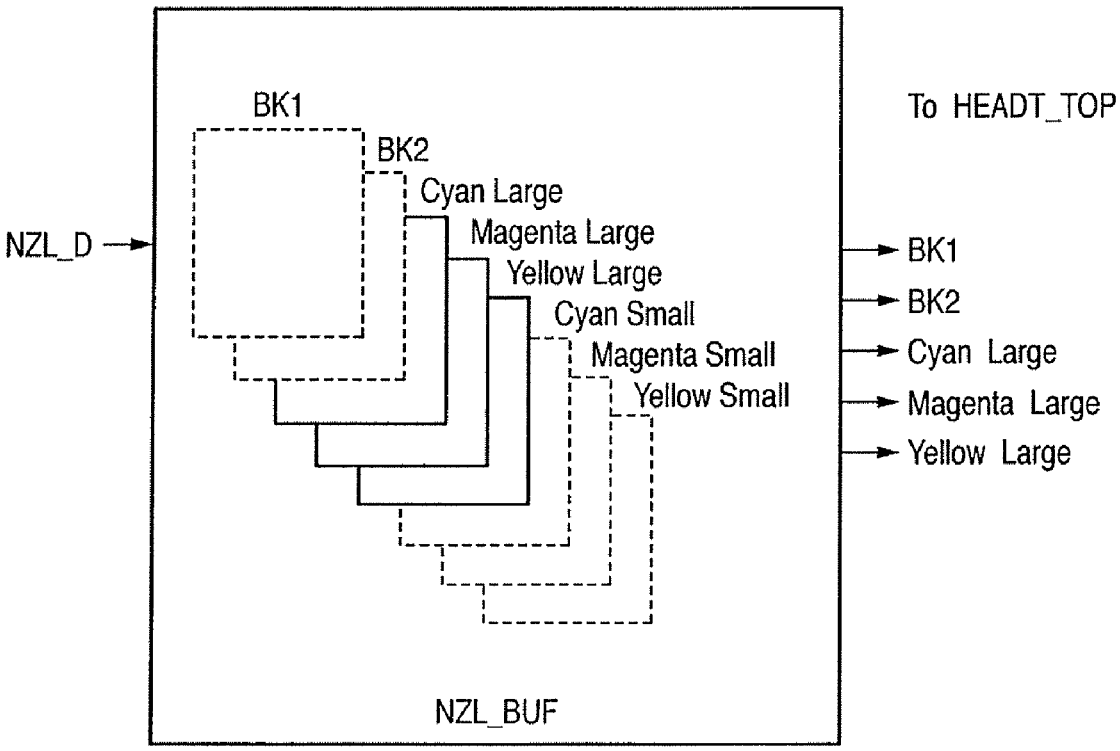
FIG. 18 is a view for explaining a nozzle buffer using method in printing using only large nozzles according to the embodiment of the present invention.

In printing using only the large color nozzle arrays, only the large color nozzle array buffers are used, and no buffers of the small nozzle arrays are used, as shown in FIG. 18. If only the small color nozzle arrays are used, only the small nozzle array buffers are used, and no buffers of the large nozzle arrays are used.

A printhead driving data generation timing to implement block toggle printing that prints one column of the large nozzle array and that of the small nozzle array in an interval of 600 dpi by time-divisionally driving the 32 blocks will be described on the basis of the present invention.

Figure 1:
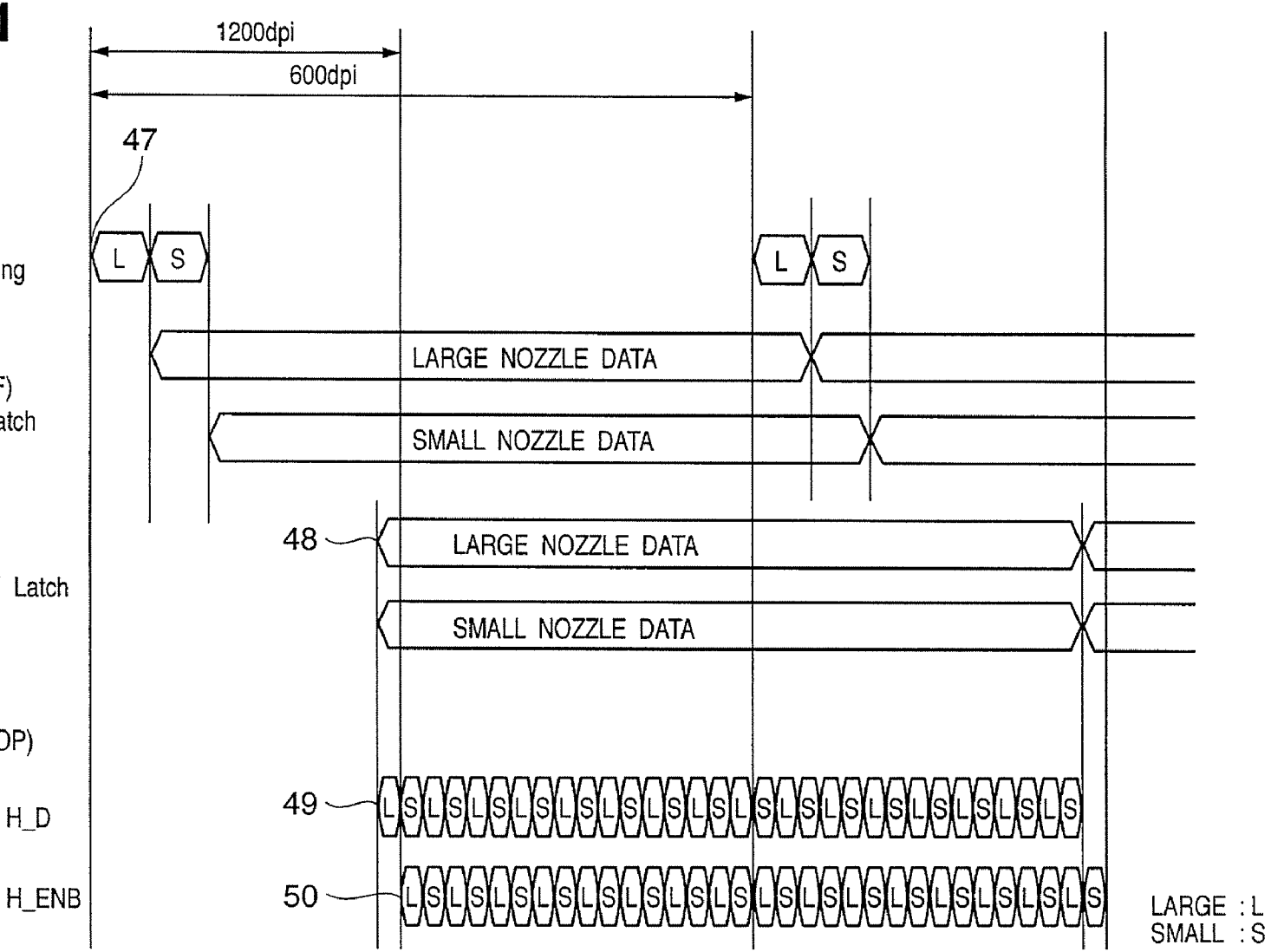
FIG. 1 is a timing chart schematically showing the data generation timing of block toggle printing by large nozzles and small nozzles according to an embodiment of the present invention.
Figure 2:
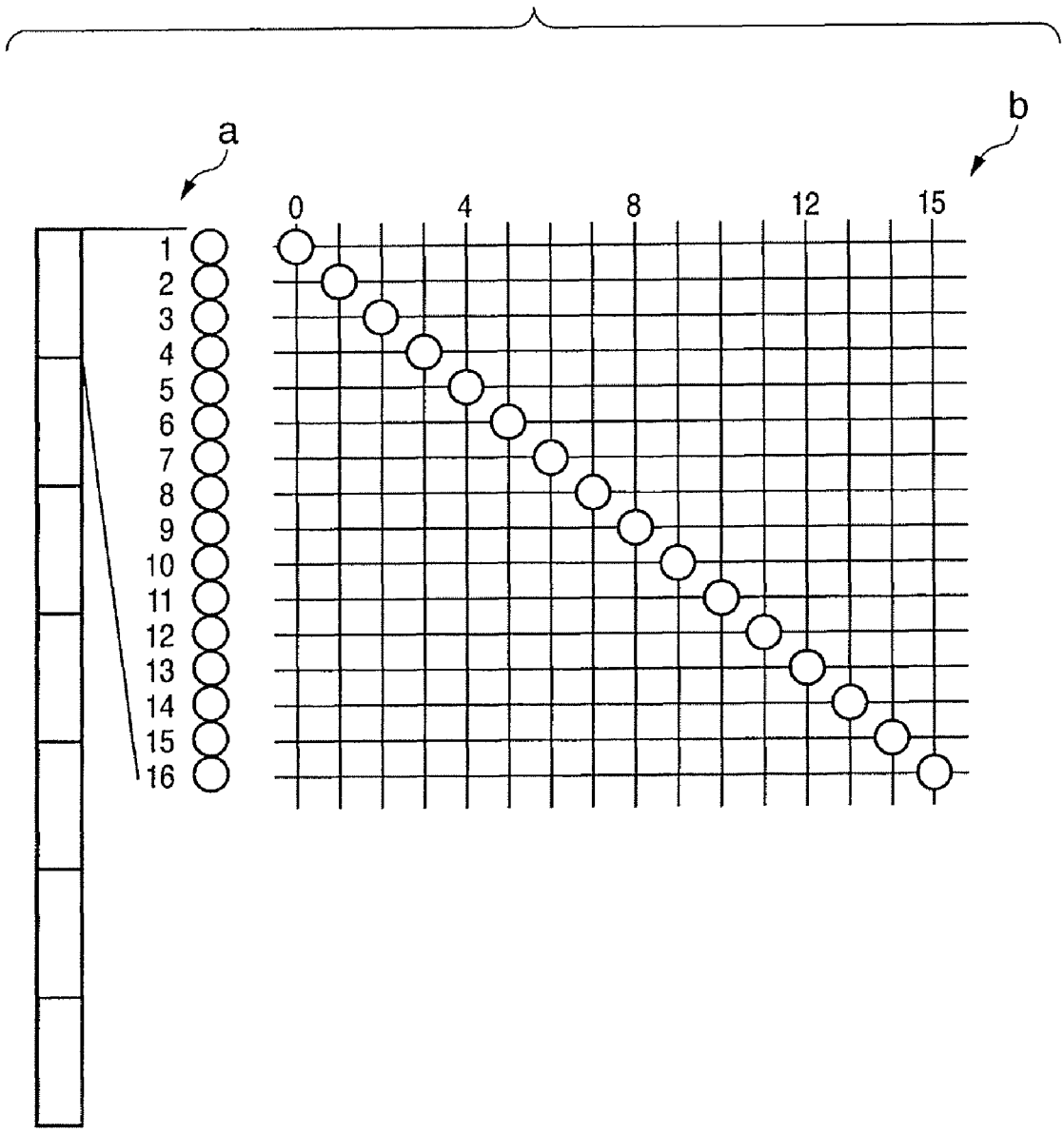
FIG. 2 is a view for explaining time-divisional drive of a printhead.

FIG. 1 shows a timing of generating, from image data saved on the RAM 16 included in the printhead control block, printhead data to be transferred to the printhead 20. The reference timing to drive functional blocks related to this print control, i.e., the resolution is 1,200 dpi.

The functional blocks related to print control are the nozzle data generation block (NZL_DG) 25, nozzle data holding block (NZL_BUFF) 26, and printhead control block (HEAD_TOP) 27.

Handling two consecutive columns as one unit enables 32 block division at 600 dpi.

In FIG. 1, the First Latch corresponds to the first buffer 34, and the Second Latch corresponds to the second buffer 35.

The nozzle data generation block (NZL_DG) 25 sequentially reads out six color image data of the large nozzle arrays and small nozzle arrays from the RAM 16 by DMA transfer from a timing 47. The image data are converted into nozzle data by rearranging them to nozzle groups for time-divisional drive shown in FIG. 12 and saved in the first buffer 34 of the nozzle data holding block (NZL_BUFF) 26.

The nozzle data generation block (NZL_DG) 25 is driven at timings corresponding to an interval of 600 dpi, i.e., activated for every two columns at an interval of 1,200 dpi. In the nozzle data holding block (NZL_BUFF) 26, the nozzle data are latched from the first buffer 34 to the second buffer 35 from a timing 48 corresponding to the last one (block 15) of the 16 blocks contained in one column.

The data are latched at the last block (block 15) of one column ahead of printing to transfer the driving data to the printhead 20 in advance such that the printhead can discharge at the last block of the next column.

The printhead control block (HEAD_TOP) 27 selects, as the printhead driving data H_D 45, the nozzle data saved in the second buffer 35 of the nozzle data holding block (NZL_BUFF) 26. More specifically, the printhead control block (HEAD_TOP) 27 alternately selects, as the printhead driving data H_D 45, large nozzle data and second nozzle data from the second buffer 35 of the nozzle data holding block (NZL_BUFF) 26 from a timing 49 at the block driving period. The nozzle data of two columns at 1,200 dpi, i.e., the nozzle data of 32 blocks at an interval of 600 dpi are transferred to the printhead 20.

The logic of SEL at the 16th bit of the printhead driving data H_D 45 toggles for each block, as shown in FIG. 15, in correspondence with the selection of the large nozzle array or small nozzle array.

The H_ENB 46 generates a heat pulse from a timing 50. As shown in FIG. 1, the timing of the H_ENB 46 delays by one block time from transfer of the printhead driving data H_D 45. This is because the nozzle data should be transferred to the printhead 20 and latched in it by the H_LATCH 43, and driving of the transferred data, i.e., discharge should be executed in the next block.

Figure 19:
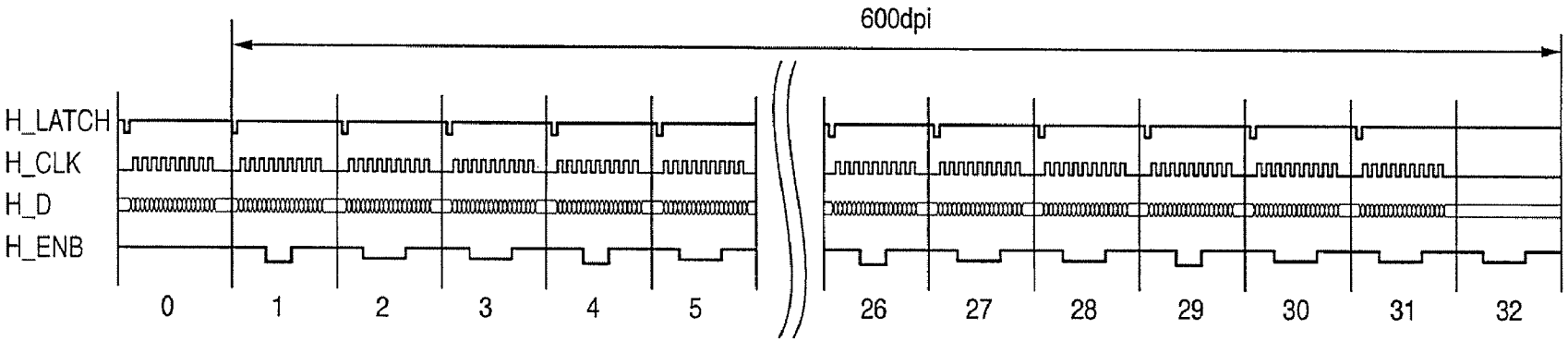
FIG. 19 is a view for explaining a printhead drive timing for 32 blocks in block toggle printing by large nozzles and small nozzles according to the embodiment of the present invention.

FIG. 19 shows the relationship between the H_LATCH 43, H_CLK 44, H_D 45, and H_ENB 46 when the 32 blocks of the large nozzle array and small nozzle array are driven by block toggle printing for each driving unit at an interval of 600 dpi.

Driving data transfer to the printhead 20 starts at a timing earlier by one block than the column to start discharge (heat). SEL at the 16th bit of the printhead driving data H_D 45 toggles for each block in correspondence with the large nozzle array and small nozzle array.

The H_ENB 46 starts heating with a delay of one block relative to the printhead driving data H_D 45. The pulse width of the H_ENB 46 indicates that a large heat pulse to drive the large nozzle array and a small heat pulse to drive the small nozzle array are alternately switched at the block driving period.

Figure 20:
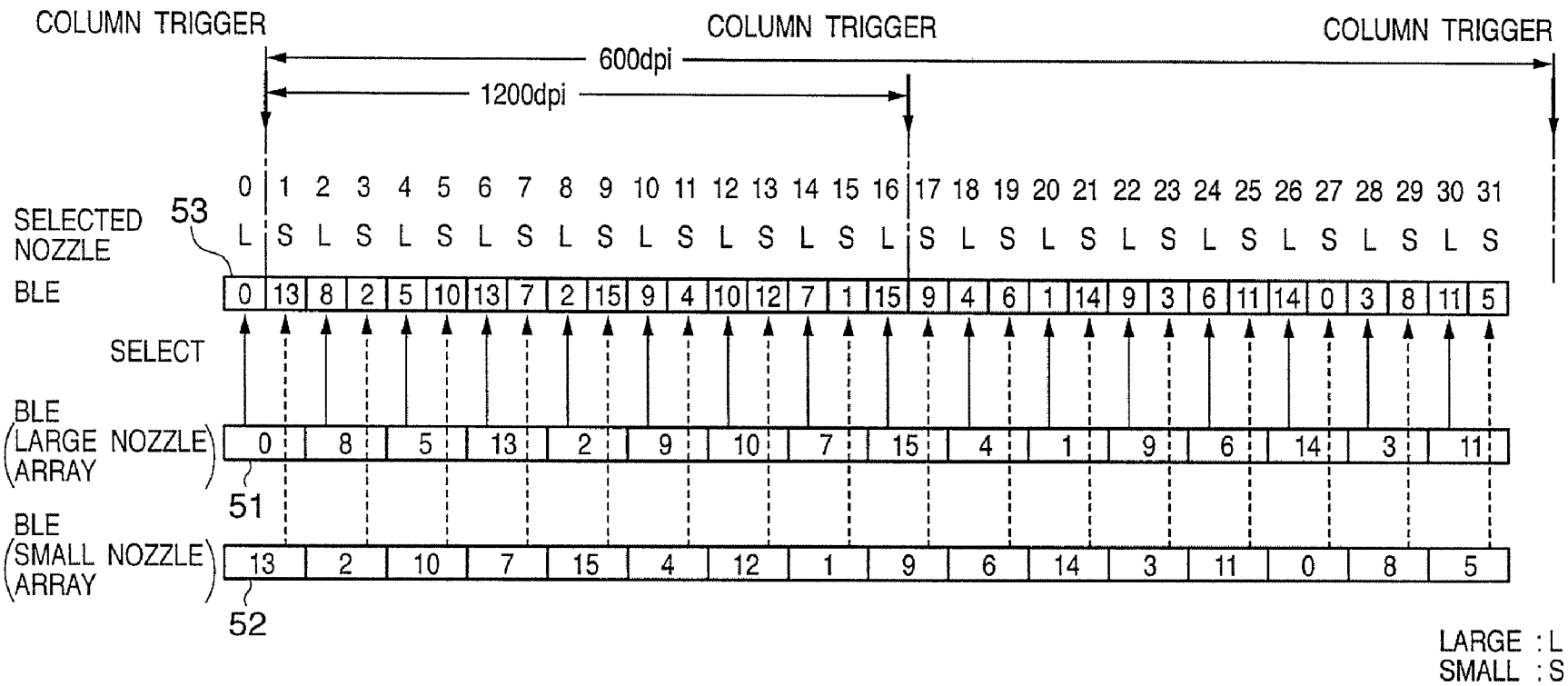
FIG. 20 is a view for explaining a block driving order setting method for large nozzles and small nozzles in block toggle printing by the large nozzles and small nozzles and a block driving order output to the printhead in a print mode according to the embodiment of the present invention.

FIG. 20 shows a method of causing the block selector block 37 of the printhead control block (HEAD_TOP) 27 to select nozzle data from the second buffer 35 of the nozzle data holding block (NZL_BUFF) 26. More specifically, FIG. 20 schematically shows a method of selecting the nozzle data of the large nozzle array and small nozzle array for every block driving. At a timing 0, data corresponding to block 0 of the large nozzle array is read out. At a timing 1, a nozzle corresponding to block 0 of the large nozzle array is driven. At the timing 1, data corresponding to block 13 of the small nozzle array is read out. At a timing 2, a nozzle corresponding to block 13 of the small nozzle array is driven. At the timing 2, data corresponding to block 8 of the large nozzle array is read out. The read process and drive process are executed sequentially in this way. Data corresponding to the driving target block is read out at a timing ahead of one block. The timings 0 to 3 correspond to the timings of the signal H_LATCH in FIG. 19.

To implement block toggle printing, the block driving order can be set for each of the large nozzle array and small nozzle array. Additionally, the block driving order of the large nozzle array and that of the small nozzle array are alternately selected for each of the 32 block of block toggle, More specifically, a block driving order 51 of the large nozzle array and a block driving order 52 of the small nozzle array are set. The block driving orders are set in the block selector 37.

In the example shown in FIG. 20, driving (printing) starts from the large nozzle array. The large nozzle and small nozzle are switched for each block. A focus is placed on only the large nozzles. In the block driving order 51 of the large nozzle array, one block is selected in every divisional drive of two blocks at an even-numbered timing and output to a block driving order 53 for block toggle printing. The block driving order transferred to the printhead 20 uses the block numbers in the block driving order 53.

Similarly, in the block driving order 52 of the small nozzle array, one block is selected in every divisional drive of two blocks at an odd-numbered timing as a block number in the block driving order 53.

As described above, the block driving order of the large nozzle array and that of the small nozzle array are alternately selected for every two blocks. This allows to arbitrarily set the block driving order of the large nozzle array and that of the small nozzle array to execute block toggle printing by the large nozzles and small nozzles.

Figure 22:
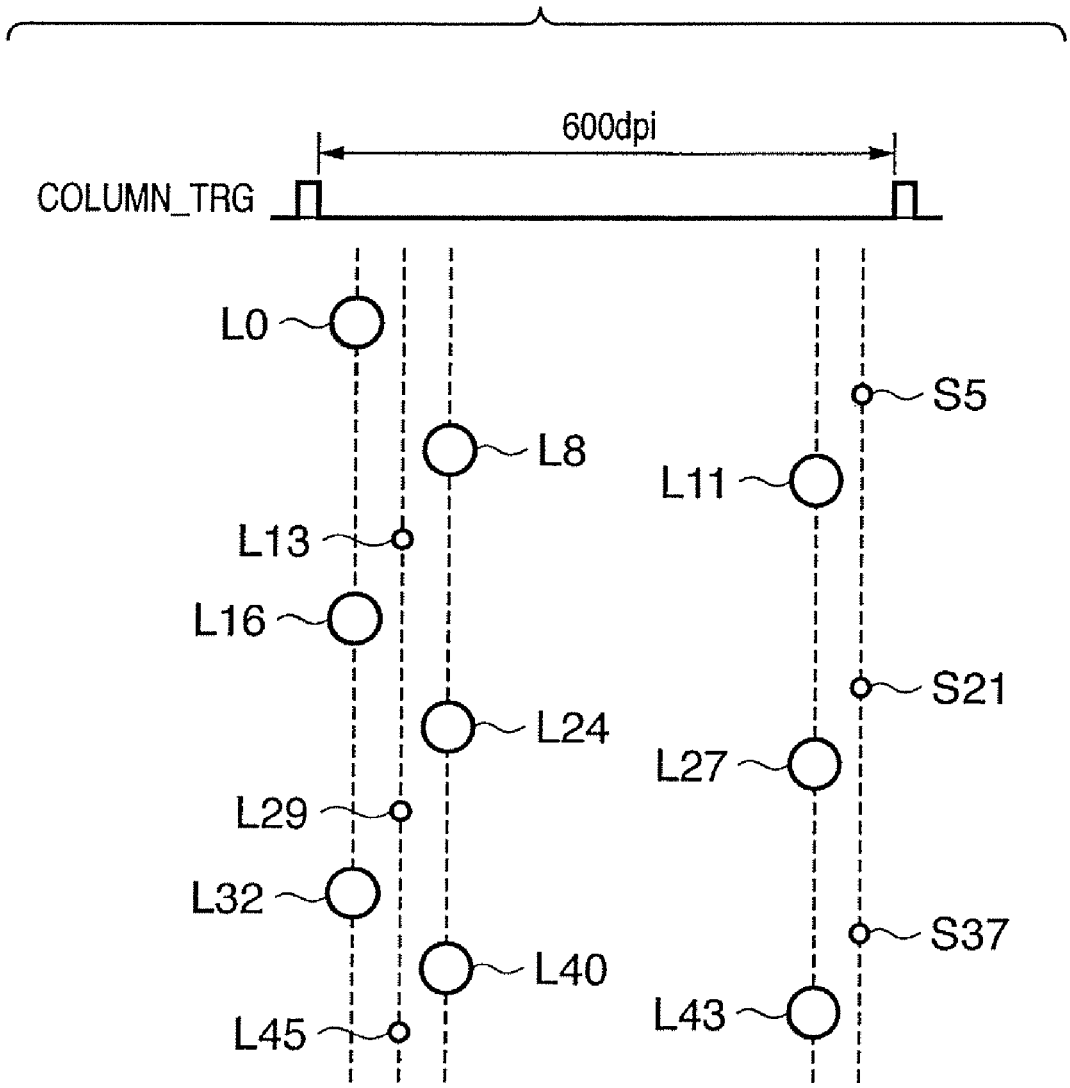
FIG. 22 is a view schematically showing distributed driving in block toggle printing by large nozzles and small nozzles in the driving order shown in FIG. 20.

FIG. 22 is an explanatory view of driving in the order shown in FIG. 20. First, the nozzles of block 0 of the large nozzle array are driven in synchronism with a signal (COLUMN_TRG). That is, the nozzles L0, L16, L32, . . . are driven. Next, the nozzles of block 13 of the small nozzle array are driven. That is, the nozzles S13, S29, S45, . . . are driven. Then, the nozzles of block 8 of the large nozzle array are driven. The blocks are driven in the order shown in FIG. 20. In FIG. 20, the nozzles of block 5 of the small nozzle array are driven finally.

In a print mode to execute printing by using only the large nozzle array, the nozzle buffer for the large nozzle array and the block driving order for the large nozzle array are set. In a print mode to execute printing by using only the small nozzle array, the nozzle buffer for the small nozzle array and the block driving order for the small nozzle array are set. To alternately toggle discharge of the large nozzle array and that of the small nozzle array in every block driving, the nozzle buffers and block driving orders for both of the large nozzle array and small nozzle array are set.

A flowchart of block toggle printing will be described next with reference to FIG. 21.

Figure 21:
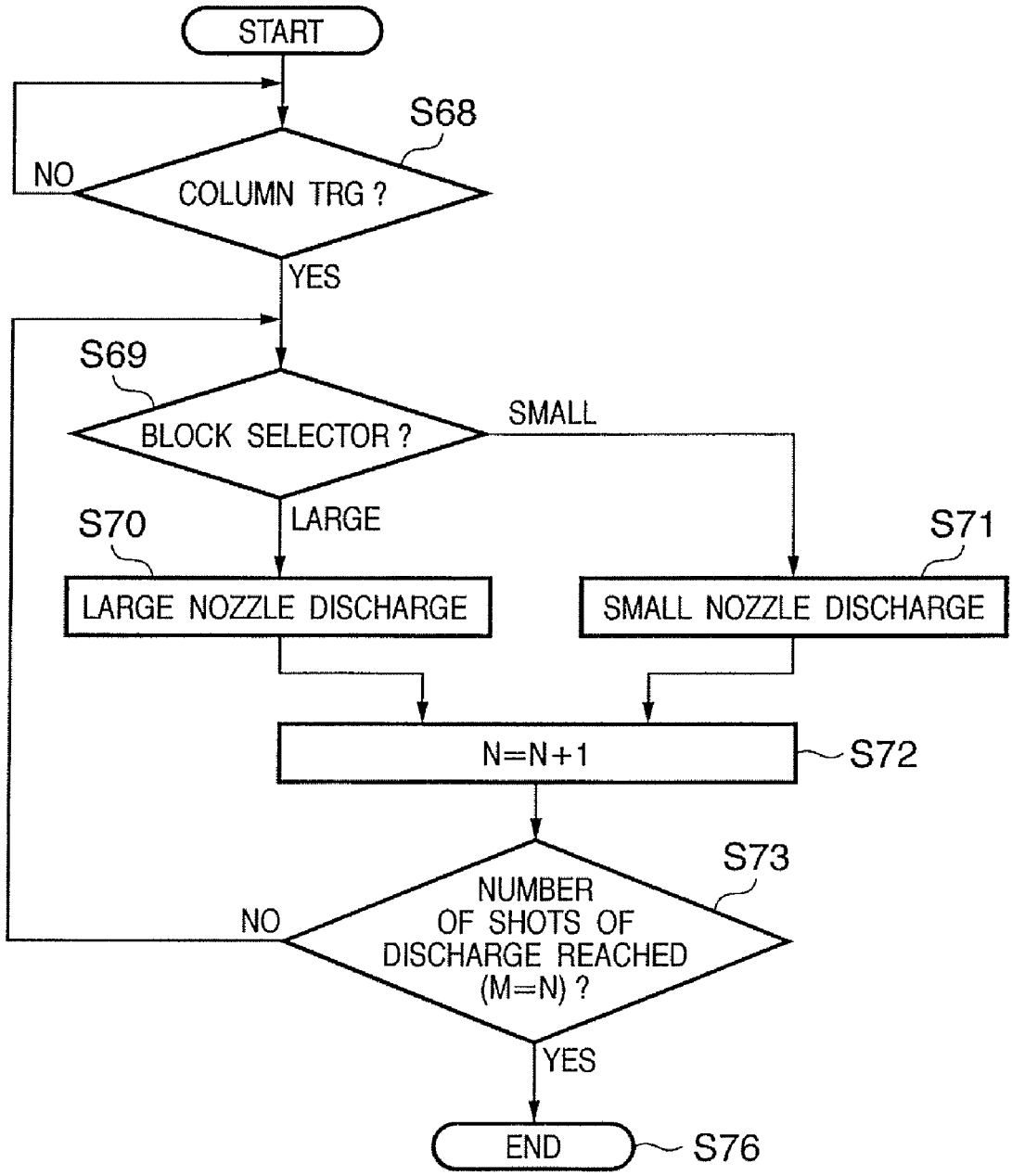
FIG. 21 is a flowchart showing the block toggle printing operation according to the embodiment of the present invention.

FIG. 21 is a flowchart showing the block toggle printing operation according to the embodiment of the present invention.

The block toggle operation is executed under the control of the CPU 15. FIG. 21 corresponds to black or color printing. The processing in FIG. 21 indicates the discharge sequence of one time of block toggle printing for one column of the large nozzle array and one column of the small nozzle array as shown in FIG. 20.

In step S68, the presence/absence of the Column TRG 29 is determined. If the Column TRG is absent (NO in step S68), the process waits until it appears. If the Column TRG is present (YES in step S68), the process advances to step S69 to determine the set state of the block selector 37. From this time, the nozzle data holding block 26 operates. The nozzle data holding block 26 has a counter to count the number of blocks. The block selector 37 selects a block of a buffer on the basis of the counter value. This operation will be described below.

If the block selector 37 selects large nozzles, the process advances to step S70 to execute discharge of the large nozzles. If the block selector 37 selects small nozzles, the process advances to step S71 to execute discharge of the small nozzles.

After execution of step S70 or S71, the number N of shots of discharge is counted in step S72. Every time discharge of one column is complete, the number N of shots of discharge is incremented by one.

In step S73, the current number N of shots of discharge is compared with the predetermined number M of shots of discharge (M=2 here). If number N of shots of discharge=predetermined number M of shots of discharge, i.e., discharge of the predetermined number of shots is executed (YES in step S73), the process advances to step S76 to end the discharge sequence of one cycle of block toggle printing. If number N of shots of discharge≠predetermined number M of shots of discharge, the process returns to step S69.

In this way, the block selector selects one of the large nozzle array and small nozzle array and then selects one of the plurality of blocks included in the selected nozzle array. Control is done to drive nozzles corresponding to the selected block. After that, the block selector selects the other nozzle array and then selects one of the plurality of blocks included in the selected nozzle array. Control is done to drive nozzles corresponding to the selected block. In this way, nozzle array selection and selection of a block included in the nozzle array are executed by using the counter so as to select all blocks of the two nozzle arrays in each column. The second buffer 35 is selected in correspondence with the block selection.

Next, printing operation (printing mode) of the printer will be described.

Figure 6:
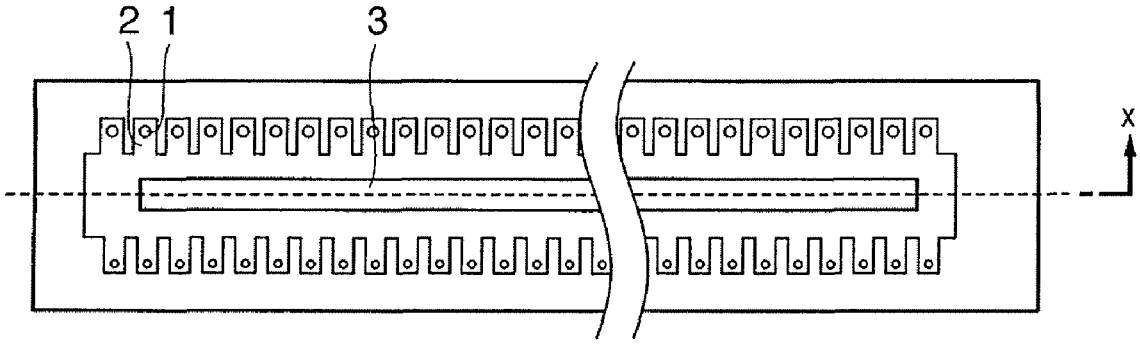
FIG. 6 is a schematic view of the structure of the nozzles of the printhead and the ink chambers in the discharge direction.
Figure 7:
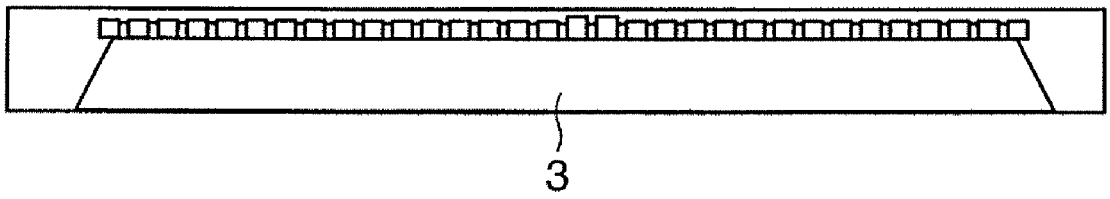
FIG. 7 is a schematic sectional view of a printhead.

FIGS. 24A, B and C are views for explaining a print mode in case of printing using a printhead with an arrangement of nozzles shown in FIG. 6.

Each columns from left in FIG. 24 indicates printing mode, types of printing medium, usage nozzle, toggle mode, the number of passes, and scanning speed of the printhead. For a column of the toggle mode, "○" is marked in case of using large nozzle and small nozzle, and block toggle printing (block toggle mode) or column toggle printing (column toggle mode) is selected. "-" is marked in case of using either large nozzle or small nozzle.

<First Arrangement Example of Printing Mode of a Printer>

FIG. 24A shows a first arrangement example of printing mode of the printer.

In FIG. 24A, there are three printing modes. In any printing modes, printing medium is a plain paper. The number of passes is 1, image forming is executed by one scanning printing for a printing medium. Since printing mode 1 is speed-oriented mode, a large nozzle is only used for printing. Scanning speed of the printhead of the printing mode 1 is 30 inch per sec.

Printing mode 2 is normal mode. In this mode, a large nozzle and a small nozzle are used for printing. In this mode, block toggle printing for alternately driving a large nozzle and a small nozzle by the block basis as described the above. Accordingly, "○" is marked at a column of the toggle mode. Scanning speed of the printhead of the printing mode 2 is 25 inch per sec.

Printing mode 3 is image quality-oriented mode. In this mode, a small nozzle is only used for printing. Scanning speed of the printhead of the printing mode 3 is 12.5 inch per sec. Since the printing mode 1 only uses a large nozzle and the printing mode 2 only uses a small nozzle, "-" is marked at a column of the toggle mode.

<Second Arrangement Example of Printing Mode of a Printer>

FIG. 24B shows a second arrangement example of printing mode of the printer.

In FIG. 24B, there are three printing modes. In any printing modes, printing medium is specialty paper. Printing mode 1 is speed-oriented mode, and printing is executed by one scanning with only a large nozzle.

Printing mode 2 is normal mode. In this mode, a large nozzle and a small nozzle are used for printing. In this printing mode 2, block toggle printing is executed. Further, since the number of passes is 2, image forming is achieved by two scanning printing, so-called, multi-pass printing.

Figure 5:
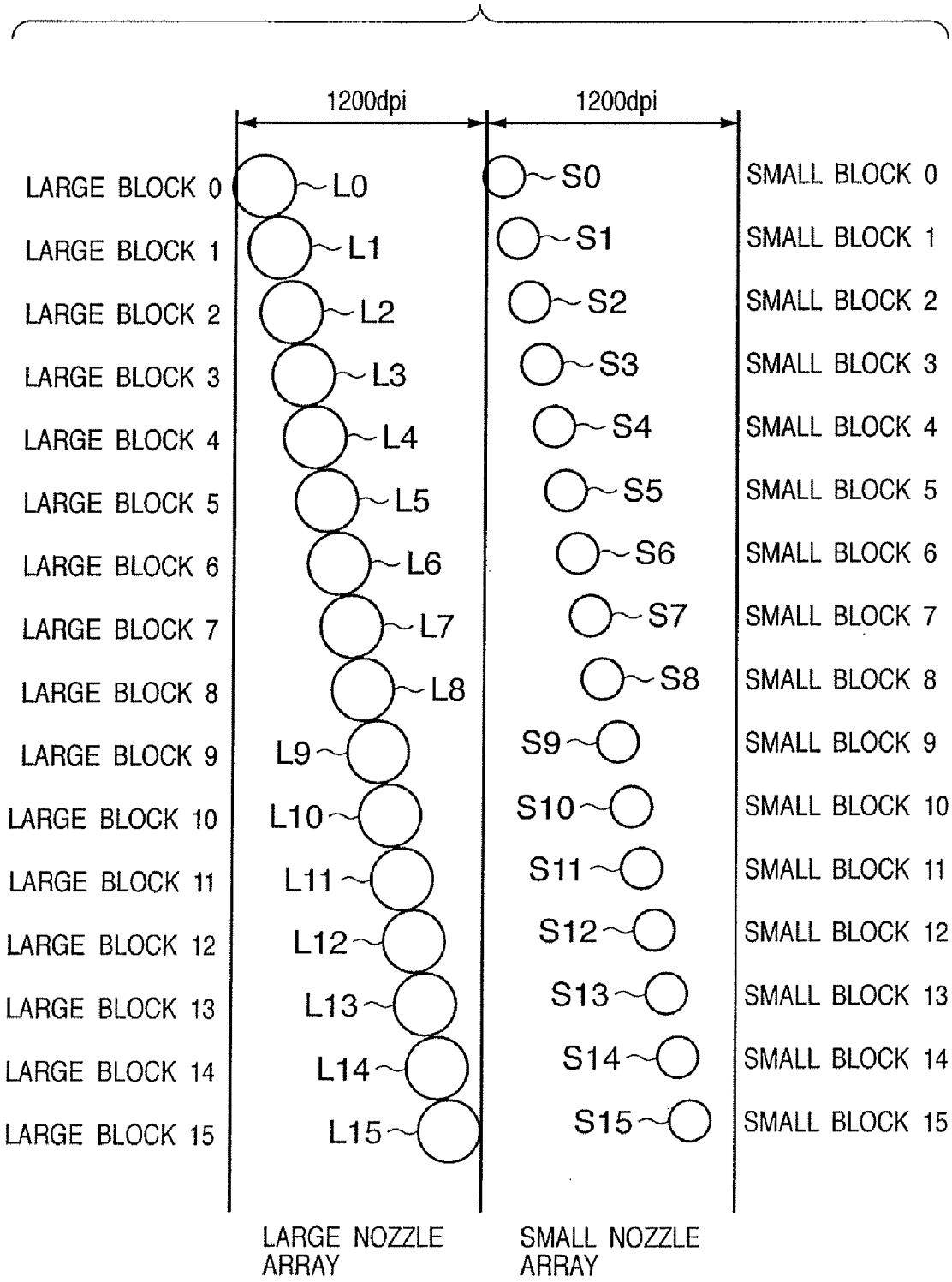
FIG. 5 is a view schematically showing distributed driving of column toggle printing by large nozzles and small nozzles.

Printing mode 3 is image quality-oriented mode. In this mode, a large nozzle and a small nozzle are used for printing and column toggle printing is executed. Thus, as shown in FIG. 5, a large nozzle and a small nozzle are alternately switched by one column basis to execute printing.

<Third Arrangement Example of Printing Mode of a Printer>

FIG. 24C shows a third arrangement example of printing mode of the printer.

In FIG. 24C, there are five printing modes. Three types (a plain sheet, specialty sheet 1 and specialty sheet 2) of printing medium are used. Explanation of each the printing modes in this case are omitted, since it is apparent by referring to explanation of FIGS. 24A and 24B.

The above embodiment of the present invention has exemplified an inkjet printer. The printer may be a multifunction printer based on an inkjet printer. The device may be a facsimile apparatus. The printhead has, as a structure to discharge ink, a plurality of printing elements including electrothermal transducers to generate heat energy. Instead, the structure may discharge ink by-contracting piezoelectric elements.

As described above, according to this embodiment, a nozzle buffer for a large nozzle array and that for a small nozzle array are prepared for each color. In this arrangement, 32 blocks are driven at an interval of 600 dpi by using two columns at a time interval corresponding to 1,200 dpi, thereby completing discharge for one column of the large nozzle array and one column of the small nozzle array.

The nozzle data of the 32 blocks are alternately selected from the nozzle buffer for the large nozzle array and that for the small nozzle array in an arbitrary order at the block driving period. The heat pulse table of the heat enable signal is switched between the large nozzles and the small nozzles, thereby driving the printhead.

The above-described arrangement toggle-switches the large nozzles and small nozzles in every block driving. A focus is placed in the ink consumption of the large nozzle array. The time lag of large nozzle array driving can be increased by inserting small nozzle array driving between the large nozzle array driving processes. This prevents ink unbalance in the common ink chamber and smoothens ink refill in the ink chambers so discharge errors hardly occur. Printing by more stable discharge can be achieved.

In the above-described embodiment, the droplet discharged from the printhead is ink, and the liquid stored in the ink tank is ink. However, the liquid stored in the ink tank is not limited to ink. For example, the ink tank may store a process solution that is discharged to a printing medium to increase the fixing properties and water resistance of a printed image or its image quality. In the above description, the relationship held between the large nozzles and the small nozzles is first nozzle diameter>second nozzle diameter. The relationship may be energy generated by heater of first nozzles>energy generated by heater of second nozzles.

The above-described embodiment of an inkjet printing scheme especially comprises a means (e.g., an electrothermal transducer or laser beam) for generating heat energy as energy utilized to discharge ink. The ink state is changed by the heat energy to increase the print density and resolution.

The representative arrangement and principle are preferably based on the fundamental principle described in, e.g., U.S. Pat. Nos. 4,723,129 and 4,740,796.

It is preferable to use a pulse-shaped driving signal described in U.S. Pat. Nos. 4,463,359 and 4,345,262. It is possible to execute more satisfactory printing by employing conditions described in U.S. Pat. No. 4,313,124 of an invention related to the temperature rise ratio of a thermal action plane.

A full line type printhead having a length corresponding to the maximum width of a printing medium printable by the printing apparatus may ensure the length by combining a plurality of printheads or by using a single integrated printhead structure.

The present invention can use the cartridge type printhead described in the above embodiment, which includes an ink tank integrated with the printhead itself. Instead, an interchangeable chip type printhead which can be electrically connected to the apparatus main body and receive ink from it when attached to the apparatus main body may be used.

It is preferable to add a printhead recovery means or preliminary means to the above-described printing apparatus to attain a more stable printing operation. Practical examples are a printhead capping means, a cleaning means, a pressurizing or suction means, an electrothermal transducer, another heating element, and a preliminary heating means formed by combining them. A preliminary discharge mode to perform discharge unrelated to printing is also effective for stable printing.

The printing apparatus can have not only a print mode using a main color such as black but also a mode using an integrated printhead or a combination of a plurality of printheads. The apparatus may have at least one of a multicolor printhead with different colors and a full-color printhead by color mixing.

The printing apparatus according to the present invention may be provided integrally or separately as an image output terminal of an information processing device such as a computer. Also, the printing apparatus can take any form of a copying apparatus combined with a reader and a facsimile apparatus having a transmitting/receiving function.

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-360835 filed on Dec. 14, 2005, 2006-331143, filed on Dec. 7, 2006, which are hereby incorporated by reference herein in their entirety.

What is claimed is:

1. A printing apparatus for printing on a printing medium by using a printhead which has a first nozzle array including a plurality of nozzles from which a first amount of ink is discharged and a second nozzle array including a plurality of nozzles from which a second amount of ink is discharged, the second amount of ink being different from the first amount of ink, wherein each of the first nozzle array and the second nozzle array is divided into a plurality of blocks, the apparatus further comprising:

driving means for driving a block in the plurality of blocks;

selection means for alternately selecting from the first nozzle array in a first driving order and from the second nozzle array in a second driving order, a block to be driven by said driving means, wherein the first driving order is different from the second driving order; and control means for time-divisionally controlling said selection means to select a block from the first nozzle array and subsequently select a block from the second nozzle array and sequentially select each following block from each nozzle array within a predetermined period, the predetermined period defining a print resolution in the main scanning direction, and wherein the printhead includes the driving means.

2. The apparatus according to claim 1, further comprising, a holding unit including a first buffer and a second buffer, corresponding to the first nozzle array and the second nozzle array, respectively, as nozzle data to be used for discharge of each nozzle, wherein the first nozzle array and the second nozzle array are prepared for each of a plurality of colors.

3. The apparatus according to claim 2, wherein said control means causes said selection means to alternately read out nozzle data from each buffer of the first nozzle array and the second nozzle array for each block and supplies the nozzle data to the printhead as driving data of the printhead.

4. The apparatus according to claim 3, wherein said control means comprises setting means for setting the first driving order and the second driving order, and said control means supplies, to the printhead together with the driving data, information representing a block number that specifies a block corresponding to the driving order set by said setting means.

5. The apparatus according to claim 1, wherein said control means counts the number of selected blocks.

6. The apparatus according to claim 1, wherein the printhead comprises a common ink chamber to supply a liquid, the first nozzle array includes first nozzles arrayed in a longitudinal direction of the common ink chamber, the second nozzle array is arranged in parallel to the first nozzle array and includes second nozzles with a nozzle diameter smaller than a nozzle diameter of the first nozzles, and a plurality of liquid chambers which have openings to the first nozzles and the second nozzles and communicate with the common liquid chamber.

7. The apparatus according to claim 1, wherein the printhead comprises a common ink chamber to supply a liquid, the first nozzle array includes first nozzles arrayed in a longitudinal direction of the common ink chamber, the second nozzle array includes second nozzles with a nozzle diameter smaller than a nozzle diameter of the first nozzles, and a third nozzle array which includes third nozzles with a nozzle diameter smaller than the nozzle diameter of the second nozzles, wherein the first nozzle array is arranged along with one side of the common ink chamber in a longitudinal direction, and the second and third nozzle arrays are arranged along with the other side of the common ink chamber in a longitudinal direction, the common ink chamber is put in parallel between the first nozzle array, and the second and third nozzle arrays, and the second nozzle array and the third nozzle array are alternately arranged along with the common ink chamber in a longitudinal direction and are communicated with the common liquid chamber.

8. The apparatus according to claim 1, wherein a diameter of a second nozzle in the second nozzle array is smaller than a diameter of a first nozzle in the first nozzle array.

9. A printing apparatus for printing on a printing medium comprising:

a printhead which has (i) a first nozzle array including a plurality of nozzles from which a first amount of ink is discharged, where the plurality of nozzles in the first nozzle array are divided into a plurality of first nozzle array blocks, (ii) a second nozzle array including a plurality of nozzles from which a second amount of ink is discharged, where the plurality of nozzles in the second nozzle array are divided into a plurality of second nozzle array blocks, and (iii) driving means for driving a block from the plurality of first nozzle array blocks or the plurality of second nozzle array blocks, wherein the first amount of ink is different from the second amount of ink;

selection means for selecting a block to be driven by the driving means from the plurality of first nozzle array blocks and the plurality of second nozzle array blocks; and control means for time-divisionally controlling said selection means to select a first block to be driven from the plurality of first nozzle array blocks and subsequently select a second block to be driven from the plurality of second nozzle array blocks, and select each following block to be driven by alternately selecting between a block from the plurality of first nozzle array blocks and a block from the plurality of second nozzle array blocks within a predetermined period, the predetermined period defining a print resolution in the main scanning direction, wherein the plurality of first nozzle array blocks are driven in a first driving order, and the plurality of second nozzle array blocks are driven in a second driving order, the first driving order being different from the second driving order.

10. The apparatus according to claim 9, further comprising, a holding unit including a first buffer and a second buffer, corresponding to the first nozzle array and the second nozzle array, respectively, as nozzle data to be used for discharge of each nozzle, wherein the first nozzle array and the second nozzle array are prepared for each of a plurality of colors.

11. The apparatus according to claim 10, wherein said control means causes said selection means to alternately read out nozzle data from each buffer of the first nozzle array and the second nozzle array for each block and supplies the nozzle data to the printhead as driving data of the printhead.

12. The apparatus according to claim 11, wherein said control means comprises setting means for setting the first driving order and the second driving order, and said control means supplies, to the printhead together with the driving data, information representing a block number that specifies a block corresponding to the driving order set by said setting means.

13. The apparatus according to claim 9, wherein the printhead comprises a common ink chamber to supply a liquid, the first nozzle array includes nozzles arrayed in a longitudinal direction of the common ink chamber, the second nozzle array is arranged in parallel to the first nozzle array and includes nozzles with a nozzle diameter smaller than a nozzle diameter of the first nozzles, and a plurality of liquid chambers which have openings to the first nozzles and the second nozzles and communicate with the common liquid chamber.

14. The apparatus according to claim 9, wherein the printhead comprises a common ink chamber to supply a liquid, the first nozzle array includes first nozzles arrayed in a longitudinal direction of the common ink chamber, the second nozzle array includes second nozzles with a nozzle diameter smaller than a nozzle diameter of the first nozzles, and a third nozzle array which includes third nozzles with a nozzle diameter smaller than the nozzle diameter of the second nozzles, wherein the first nozzle array is arranged along with one side of the common ink chamber in a longitudinal direction, and the second and third nozzle arrays are arranged along with the other side of the common ink chamber in a longitudinal direction, the common ink chamber is put in parallel between the first nozzle array, and the second and third nozzle arrays, and the second nozzle array and the third nozzle array are alternately arranged along with the common ink chamber in a longitudinal direction and are communicated with the common liquid chamber.

15. The apparatus according to claim 9, wherein a diameter of a second nozzle in the second nozzle array is smaller than a diameter of a first nozzle in the first nozzle array.

16. A control method of a printing apparatus for printing on a printing medium by using a printhead which includes: a first nozzle array including a plurality of nozzles from which a first amount of ink is discharged, and a second nozzle array including a plurality of nozzles from which a second amount of ink is discharged, the second amount of ink being different from the first amount of ink, wherein each of the first nozzle array and the second nozzle array is divided into a plurality of blocks, the method comprising:

a driving step of driving a block in the plurality of blocks;

a selecting step of alternately selecting from the first nozzle array in a first driving order and from the second nozzle array in a second driving order, a block to be driven in the driving step, wherein the first driving order is different from the second driving order; and a controlling step of time-divisionally controlling the selecting step to select a block from the first nozzle array and subsequently select a block from the second nozzle array and sequentially select each following block from each nozzle array within a predetermined period, the predetermined period defining a print resolution in the main scanning direction.

* * * * *